US010302292B2

(12) United States Patent
May

(10) Patent No.: US 10,302,292 B2
(45) Date of Patent: May 28, 2019

(54) CONNECTOR SYSTEM FOR LIGHTING ASSEMBLY

(71) Applicant: Michael W. May, Lakewood, IL (US)

(72) Inventor: Michael W. May, Lakewood, IL (US)

( * ) Notice: Subject to any disclaimer, the term of this patent is extended or adjusted under 35 U.S.C. 154(b) by 156 days.

(21) Appl. No.: 15/401,537

(22) Filed: Jan. 9, 2017

(65) Prior Publication Data

US 2017/0198896 A1 Jul. 13, 2017

Related U.S. Application Data

(60) Provisional application No. 62/422,521, filed on Nov. 15, 2016, provisional application No. 62/276,075, filed on Jan. 7, 2016.

(51) Int. Cl.
*F21V 23/06* (2006.01)
*F21V 29/74* (2015.01)
(Continued)

(52) U.S. Cl.
CPC ..... *F21V 23/06* (2013.01); *F21K 9/20* (2016.08); *F21K 9/272* (2016.08); *F21K 9/278* (2016.08);
(Continued)

(58) Field of Classification Search
None
See application file for complete search history.

(56) References Cited

U.S. PATENT DOCUMENTS 2,137,174 A 11/1938 Marshaus
3,131,871 A 5/1964 Foulds
(Continued)

FOREIGN PATENT DOCUMENTS

CN 1690505 A 11/2005
CN 201448641 U 5/2010
(Continued)

OTHER PUBLICATIONS

Notification of Transmittal of the International Search Report and the Written Opinion of the International Searching Authority, for International Application No. PCT/US2017/12700, dated Jul. 19, 2018.
(Continued)

*Primary Examiner* — Elmito Breval
(74) *Attorney, Agent, or Firm* — Fitch, Even, Tabin & Flannery LLP

(57) ABSTRACT

An elongate tubular lighting assembly having a body with a length between spaced first and second ends. The tubular lighting assembly has an elongate heat sink and a light source comprising LED emitters and first and second connectors respectively at the first and second body ends for securing the lighting assembly to a light fixture. The first connector has cooperating first and second parts having first and second surfaces. The first and second connector parts are configured so that the first and second surfaces are placed in confronting relationship to prevent separation of the first and second connector parts with the body in an operative state as an incident of the first connector part moving relative to the second connector part from a position fully separated from the second connector part in a substantially straight path that is transverse to the length of the body into an engaged position. The first connector part has conductive power and ground pins and the second connector part has conductive power and ground terminals for connecting with an external power supply and providing a grounding path for components of the lamp. The power and ground pins of the first connector part are configured to engage the power and ground terminals of the second connector part as an incident of the first connector part moving relative to the second connector part into the engaged position. A sleeve connector
(Continued)

is also provided for mounting a non-power end of a linear LED lamp to a light fixture.

2 Claims, 15 Drawing Sheets

(51) Int. Cl.

| | |
|---|---|
| ***F21V 29/89*** | (2015.01) |
| ***F21K 9/272*** | (2016.01) |
| ***F21K 9/278*** | (2016.01) |
| ***F21V 15/015*** | (2006.01) |
| ***F21V 23/00*** | (2015.01) |
| ***F21V 23/02*** | (2006.01) |
| ***H01R 13/627*** | (2006.01) |
| ***H01R 33/08*** | (2006.01) |
| ***F21V 19/00*** | (2006.01) |
| ***F21V 21/002*** | (2006.01) |
| ***F21K 9/20*** | (2016.01) |
| *F21K 9/66* | (2016.01) |
| *F21Y 103/10* | (2016.01) |
| *F21Y 115/10* | (2016.01) |
| *F21V 3/02* | (2006.01) |

(52) U.S. Cl.
CPC ..... *F21V 15/015* (2013.01); *F21V 19/0085* (2013.01); *F21V 21/002* (2013.01); *F21V 23/001* (2013.01); *F21V 23/02* (2013.01); *F21V 29/74* (2015.01); *F21V 29/89* (2015.01); *H01R 13/6273* (2013.01); *H01R 33/0845* (2013.01); *F21K 9/66* (2016.08); *F21V 3/02* (2013.01); *F21Y 2103/10* (2016.08); *F21Y 2115/10* (2016.08)

(56) References Cited

U.S. PATENT DOCUMENTS 3,404,268 A 10/1968 Fowler
D246,930 S 1/1978 Win
4,156,553 A 5/1979 Ammon et al.
5,434,762 A 7/1995 Shemitz
5,457,905 A 10/1995 Kaplan
5,624,274 A 4/1997 Lin
D397,481 S 8/1998 Schafer
5,947,761 A 9/1999 Pepe
D421,815 S 3/2000 Herst et al.
D430,326 S 8/2000 Littman
D438,326 S 2/2001 Kan
6,231,373 B1 5/2001 Daoud
6,257,735 B1 7/2001 Baar
6,283,612 B1 9/2001 Hunter
6,350,158 B1 2/2002 Arnett et al.
D459,012 S 6/2002 Shemitz et al.
D459,517 S 6/2002 Shemitz et al.
6,548,967 B1 4/2003 Dowling et al.
6,577,080 B2 6/2003 Lys et al.
6,578,979 B2 6/2003 Truttmann-Battig
6,623,151 B2 9/2003 Pederson
D500,883 S 1/2005 Herst et al.
D500,884 S 1/2005 O'Rourke
D503,009 S 3/2005 Salman
6,969,954 B2 11/2005 Lys
7,049,761 B2 5/2006 Timmermans et al.
D523,165 S 6/2006 Schultz
7,195,370 B2 3/2007 Riblett et al.
D543,305 S 5/2007 Wang
7,309,965 B2 12/2007 Dowling et al.
D565,785 S 4/2008 Kerr
D574,105 S 7/2008 Shuai et al.
7,393,223 B1 7/2008 Koda
D575,898 S 8/2008 Tran et al.
D581,569 S 11/2008 Levine
7,476,004 B2 1/2009 Chan
D589,199 S 3/2009 Pedersen
7,507,001 B2 3/2009 Kit
7,510,299 B2 3/2009 Timmermans et al.
7,513,637 B2 4/2009 Kelly et al.
7,559,790 B2 7/2009 Boeck et al.
7,587,289 B1 9/2009 Sivertsen
D605,343 S 12/2009 Watt
D607,145 S 12/2009 Yu
7,637,636 B2 12/2009 Zheng et al.
D616,382 S 5/2010 Lin et al.
7,712,918 B2 5/2010 Siemiet et al.
7,815,338 B2 10/2010 Siemiet et al.
D627,095 S 11/2010 Miyairi et al.
D634,470 S 3/2011 Hsieh
7,918,580 B2 4/2011 Liu
7,926,975 B2 4/2011 Siemiet et al.
7,938,562 B2 5/2011 Ivey et al.
7,946,729 B2 5/2011 Ivey et al.
D642,326 S 7/2011 Leadford et al.
7,976,185 B2 7/2011 Uang et al.
7,976,187 B2 7/2011 Villard
7,976,196 B2 7/2011 Ivey et al.
7,989,827 B2 8/2011 Hsu
8,011,794 B1 9/2011 Sivertsen
D649,282 S 11/2011 McDonald et al.
8,052,295 B2 11/2011 Kim et al.
8,093,823 B1 1/2012 Ivey et al.
D654,208 S 2/2012 Marquardt et al.
8,118,447 B2 2/2012 Simon et al.
8,164,281 B2 4/2012 Warton
8,186,847 B2 5/2012 Hu et al.
8,203,260 B2 6/2012 Li et al.
8,214,084 B2 7/2012 Ivey et al.
8,235,539 B2 8/2012 Thomas et al.
8,247,985 B2 8/2012 Timmermans et al.
8,251,544 B2 8/2012 Ivey et al.
8,256,924 B2 9/2012 Simon et al.
8,282,247 B2 10/2012 Ivey et al.
8,287,144 B2 10/2012 Pedersen et al.
8,322,878 B2 12/2012 Hsia
8,324,817 B2 12/2012 Ivey et al.
8,330,381 B2 12/2012 Langovsky
8,344,641 B1 1/2013 Isaacson et al.
8,360,599 B2 1/2013 Ivey et al.
8,382,327 B2 2/2013 Timmermans et al.
8,398,253 B2 3/2013 Sivertsen
8,408,742 B2 4/2013 Tran
D682,463 S 5/2013 Bernard
8,434,891 B1 5/2013 Ham
8,444,292 B2 5/2013 Ivey et al.
8,454,193 B2 6/2013 Simon et al.
8,523,394 B2 9/2013 Simon et al.
8,534,873 B1 9/2013 Soderman et al.
D691,750 S 10/2013 Mackiewicz
D692,597 S 10/2013 Simon et al.
8,547,036 B2 10/2013 Tran
8,556,452 B2 10/2013 Simon et al.
8,558,413 B1 10/2013 Lepard
8,560,261 B1 10/2013 Sivertsen
8,571,716 B2 10/2013 Ivey et al.
8,573,813 B2 11/2013 Ivey et al.
8,596,813 B2 12/2013 Ivey
8,616,720 B2 12/2013 Carney et al.
D698,075 S 1/2014 Klus
8,628,216 B2 1/2014 Ivey et al.
8,643,298 B2 2/2014 Palazzolo et al.
8,653,984 B2 2/2014 Ivey et al.
D701,639 S 3/2014 Maxik et al.
8,664,880 B2 3/2014 Ivey et al.
8,674,626 B2 3/2014 Siemiet et al.
8,678,610 B2 3/2014 Simon et al.
8,702,265 B2 4/2014 May
8,710,759 B1 4/2014 Isaacson et al.
8,742,680 B2 6/2014 Cowburn
8,807,785 B2 8/2014 Ivey et al.
8,827,486 B2 9/2014 Lai
8,830,080 B2 9/2014 Ivey et al.
8,836,476 B2 9/2014 Campbell et al.

(56) References Cited

U.S. PATENT DOCUMENTS

| | | | |
|---|---|---|---|
| 8,866,414 | B2 | 10/2014 | Maxik et al. |
| 8,915,756 | B2 | 12/2014 | Schumacher et al. |
| 8,919,991 | B2 | 12/2014 | Lee et al. |
| 8,941,330 | B2 | 1/2015 | Ng et al. |
| 8,956,005 | B2 | 2/2015 | Thomas et al. |
| 8,967,825 | B2 | 3/2015 | Fukui |
| 9,080,760 | B1 | 7/2015 | Soderman et al. |
| 9,101,028 | B2 | 8/2015 | Isaacson et al. |
| 9,155,171 | B1 | 10/2015 | Hughes et al. |
| 9,215,755 | B2 | 12/2015 | Saur et al. |
| 9,228,727 | B2 | 1/2016 | May |
| 9,247,623 | B2 | 1/2016 | Recker et al. |
| 9,285,085 | B2 | 3/2016 | Carney et al. |
| 9,295,142 | B1 | 3/2016 | Leinen et al. |
| 9,295,144 | B2 | 3/2016 | Bora et al. |
| 9,307,621 | B1 | 4/2016 | Parello et al. |
| 9,328,882 | B2 | 5/2016 | Spiro |
| 9,338,860 | B2 | 5/2016 | Radermacher |
| 9,391,415 | B2 | 7/2016 | Swedberg |
| 9,464,791 | B2 | 10/2016 | May |
| 9,464,792 | B2 | 10/2016 | May |
| 9,464,793 | B2 | 10/2016 | May |
| 9,470,401 | B2 | 10/2016 | May |
| 2002/0047646 | A1 | 4/2002 | Lys |
| 2002/0096347 | A1 | 7/2002 | Pyron |
| 2004/0095078 | A1 | 5/2004 | Leong |
| 2006/0012981 | A1 | 1/2006 | Noh |
| 2007/0159828 | A1 | 7/2007 | Wang |
| 2007/0246714 | A1 | 10/2007 | Koike et al. |
| 2007/0258202 | A1 | 11/2007 | Cooley |
| 2010/0003860 | A1 | 1/2010 | Mateo Ferrus et al. |
| 2010/0039813 | A1 | 2/2010 | Sloan et al. |
| 2010/0072921 | A1 | 3/2010 | Weatherley |
| 2010/0079075 | A1 | 4/2010 | Son |
| 2010/0112845 | A1 | 5/2010 | Lam et al. |
| 2010/0190455 | A1 | 7/2010 | Hashizume |
| 2010/0254148 | A1 | 10/2010 | Huang et al. |
| 2010/0327768 | A1 | 12/2010 | Kong et al. |
| 2011/0019421 | A1 | 1/2011 | Lai |
| 2011/0199005 | A1 | 8/2011 | Bretschneider et al. |
| 2011/0199769 | A1 | 8/2011 | Bretschneider et al. |
| 2011/0280020 | A1 | 11/2011 | Chen et al. |
| 2011/0292647 | A1 | 12/2011 | Chang |
| 2012/0049739 | A1 | 3/2012 | Clough |
| 2012/0069557 | A1 | 3/2012 | Bolscher |
| 2012/0147598 | A1 | 6/2012 | Ivey |
| 2012/0201022 | A1 | 8/2012 | Van de Ven et al. |
| 2012/0229025 | A1 | 9/2012 | Edwards, Jr. et al. |
| 2013/0119896 | A1 | 5/2013 | Fukano |
| 2013/0135851 | A1 | 5/2013 | Ham |
| 2013/0141906 | A1 | 6/2013 | Wang et al. |
| 2013/0258668 | A1 | 10/2013 | Dellian et al. |
| 2013/0279160 | A1 | 10/2013 | Myers et al. |
| 2013/0329414 | A1 | 12/2013 | Kusunose |
| 2013/0343037 | A1 | 12/2013 | Alexander |
| 2014/0056009 | A1 | 2/2014 | Swedberg |
| 2014/0133400 | A1 | 5/2014 | Ruan et al. |
| 2014/0218905 | A1 | 8/2014 | Ono et al. |
| 2014/0268752 | A1 | 9/2014 | Werr et al. |
| 2014/0293595 | A1 | 10/2014 | May |
| 2015/0049475 | A1 | 2/2015 | Pan et al. |
| 2015/0351205 | A1 | 12/2015 | Clark et al. |
| 2016/0227629 | A1 | 8/2016 | Conner et al. |
| 2017/0023193 | A1 | 1/2017 | Thosteson et al. |

FOREIGN PATENT DOCUMENTS

| | | | |
|---|---|---|---|
| CN | 101936469 | A | 1/2011 |
| EP | 2418422 | A2 | 2/2012 |
| FR | 2675958 | | 10/1992 |
| JP | S6144785 | | 3/1986 |
| JP | 2007165051 | A | 6/2007 |
| JP | 200884856 | | 4/2008 |
| JP | 2012230864 | | 11/2012 |
| JP | 3185411 | | 8/2013 |
| WO | 2013121580 | A1 | 8/2013 |
| WO | 2013151565 | | 10/2013 |

OTHER PUBLICATIONS

Office Action issued in Japanese Application No. 2017-506639 dated Jun. 12, 2018 (19 pgs.).

Extended European search report issued in European Application No. 12873713.7-1757 dated Jan. 29, 2016 (9 pages).

Notification of Transmittal of the International Search Report and the Written Opinion of the International Searching Authority, or the Declaration from the International Bureau of WIPO for International Application No. PCT/US15/26409, dated Jul. 30, 2015, 17 pages.

Notification of Transmittal of the International Search Report and the Written Opinion of the International Searching Authority, or the Declaration from the International Bureau of WIPO for International Application No. PCT/US17/12700, dated Mar. 31, 2017, 16 pages.

Notification of Transmittal of the International Search Report and the Written Opinion of the International Searching Authority, or the Declaration from the International Bureau of WIPO for International Application No. PCT/US2012/037242, dated Aug. 13, 2012, 13 pages.

Office Action including Search Report issued in Chinese Application No. 2012800737587 dated Jan. 28, 2016 (8 pages).

CONNECTOR SYSTEM FOR LIGHTING ASSEMBLY

CROSS-REFERENCE TO RELATED APPLICATIONS

This application claims the benefit of U.S. Provisional Patent Application No. 62/276,075, entitled "Connector System For Lighting Assembly" and filed Jan. 7, 2016, which is hereby incorporated by reference in its entirety. This application also claims the benefit of U.S. Provisional Patent Application No. 62/422,521, entitled "Connector System For Lighting Assembly" and filed Nov. 15, 2016, which is hereby incorporated by reference in its entirety.

FIELD

This invention relates to lighting and, more particularly, to light emitting diode (LED) illumination as well as tubular lighting assemblies.

BACKGROUND

Over the years various types of illuminating assemblies and devices have been developed for indoor and/or outdoor illumination, such as torches, oil lamps, gas lamps, lanterns, incandescent bulbs, neon signs, fluorescent bulbs, halogen lights, and light emitting diodes. These conventional prior art illuminating assemblies and devices have met with varying degrees of success.

Incandescent light bulbs create light by conducting electricity through a thin filament, such as a tungsten filament, to heat the filament to a very high temperature so that it glows and produces visible light. Incandescent light bulbs emit a yellow or white color. Incandescent light bulbs, however, are very inefficient, as a high percentage of energy input is lost as heat.

Fluorescent lamps conduct electricity through mercury vapor, which produces ultraviolet (UV) light. The ultraviolet light is then absorbed by a phosphor coating inside the lamp, causing it to glow, or fluoresce. While the heat generated by fluorescent lamps is much less than its incandescent counterparts, energy is still lost in generating the UV light and converting UV light into visible light. If the lamp breaks, exposure to mercury can occur. Linear fluorescent lamps are often five to six times the cost of incandescent bulbs but have life spans around 10,000 and 20,000 hours. Some fluorescent lights flicker and the quality of the fluorescent light tends to be a harsh white due to the lack of a broad band of frequencies. Most fluorescent lights are not compatible with dimmers.

Conventional fluorescent lights typically utilize a bi-pin/2-pin means on the tubular body that mechanically supports the body in an operative state on lamp holders of the ceiling lighting fixture and effects electrical connection of the illumination source to a power supply. A ballast associated with the lighting fixture converts AC line voltage to the DC power provided to the florescent tube. The ballast also reduces the power supply to a voltage level suitable for use in a florescent tube. A starter circuit for providing a voltage pulse is needed to cause current to conduct through the ionized gas in the fluorescent tube.

Light emitting diode (LED) lighting is particularly useful. Light emitting diodes (LEDs) offer many advantages over incandescent and fluorescent light sources, including: lower energy consumption, longer lifetime, improved robustness, smaller size, faster switching, and excellent durability and reliability. LEDs emit more light per watt than incandescent light bulbs. LEDs can be tiny and easily placed on printed circuit boards. LEDs activate and turn on very quickly and can be readily dimmed. LEDs emit a cool light with very little infrared light. LEDs come in multiple colors which are produced without the need for filters. LEDs of different colors can be mixed to produce white light.

The operational life of some white LED lamps is 100,000 hours, which is much longer than the average life of an incandescent bulb or fluorescent lamp. Another important advantage of LED lighting is reduced power consumption. An LED circuit will approach 80% efficiency, which means 80% of the electrical energy is converted to light energy; the remaining 20% is lost as heat energy. Incandescent bulbs, however, operate at about 20% efficiency with 80% of the electrical energy lost as heat.

Linear LED tube lighting products for replacing fluorescent lighting typically comprise an array of LEDs mounted on one or more circuit boards. The LED boards are mounted on an elongate heat sink comprising a heat conducting material such as aluminum. The LED circuit boards are in thermal contact with the heat sink, but electrically isolated from the heat sink. The LED tube lamp may include internal driver module containing circuitry for converting AC line current to DC current and controlling the voltage applied to the LEDs. The internal driver circuitry can be designed specifically to meet the electrical requirements of the LED circuit boards, thus overcoming potential problems associated with using the existing local ballast originally designed for powering fluorescent lamps. In some designs, however, an external local ballast is used. The high power LEDs, as well as any internal driver module, generate heat that must be dissipated by the heat sink. To facilitate heat dissipation to the atmosphere, the heat sink is typically disposed such that its external surface forms a portion of the outer surface of the tube lighting assembly. The lighting assembly is installed such that the heat sink faces upward toward the ceiling lighting fixture. The remaining circumference of the tube comprises a translucent or transparent lens cover through which the generated light is emitted. The lens cover faces towards the space to be illuminated when the LED lighting assembly is installed in a ceiling or other lighting fixture.

The linear LED lamp heat sink is typically fabricated of an electrically conductive metallic material such as aluminum or aluminum alloys. These materials dissipate heat efficiently without a significant increase in surface temperature. The heat sink itself, as well as the printed circuit LED boards and other electrical components within the linear LED tube assembly, present a safety hazard without proper electrical grounding. This is because the line voltage or voltage input to the LED boards could be applied to the heat sink in the event of a short circuit, for example, if the insulation between the LEDs and/or internal driver circuitry and the heat sink is inadequate or deteriorates during use. This could lead to other components within the assembly overheating and creating a fire hazard. It also creates an electrical shock hazard should the user come into physical contact with the heat sink when inspecting the installed lamp. The electrical components within the lamp, such as LEDs and driver circuits, are also susceptible of being damaged in the event of a power surge. With the recent introduction of sensors, cameras, control and data communications circuitry and other "smart lighting" components into linear LED lamp formats, a comprehensive protective grounding system is required.

One type of LED tube lamp is designed for the insert and rotate type lamp holders mounted on conventional fluorescent ceiling lighting fixtures, known in the industry as "tombstone" lamp holders. Such lamp holders are designed to engage electrical power pins projecting in cantilever fashion from the ends of a cylindrical shaped fluorescent tube lamp, or LED replacement tube lamp. The exposed pins on the ends of the linear LED tube are susceptible to damage during distribution and installation. The lamp body must be situated in a first angular orientation to direct the pins into the lamp holders mounted on a support/reflector and is thereafter turned to effect mechanical securement and electrical connection. Installation requires a precise initial angular orientation of the body and subsequent controlled repositioning thereof to simultaneously seat the pins at the opposite ends of the body. Often one or more of the pins are misaligned during this process so that electrical connection is not established. The same misalignment may cause a compromised mechanical connection whereupon the body may escape from the connectors and drop so that it is damaged or destroyed.

Further, the connectors on the support/reflector are generally mounted in such a fashion that they are prone to flexing. Even a slight flexing of the connectors on the support might be adequate to release the pins at one body end so that the entire body becomes separated. The conventional bi-pin and tombstone lamp holder connector means was created for very lightweight fluorescent lighting and not designed for LED tubular lighting that has additional weight due to the required heat sink and PCB boards. The weight of the body by itself may produce horizontal force components that wedge the connectors on the support/reflector away from each other so that the body becomes precariously situated or fully releases.

U.S. Pat. No. 8,434,891 to Ham proposes a LED tube and socket assembly adapted from the conventional insert and rotate type lamp holder system. The disclosed LED tube features a three pin interface projecting from each end of the tube wherein a middle pin is connected to the heat sink. The lamp holder includes a ground terminal, which receives the middle pin and in turn is connected to an external ground via a ground strap. While this approach provides a grounded heat sink, it does not overcome the above-mentioned problems associated with utilizing external pins in an insert and rotate lamp holder for securing linear LED tube lamps. It does not provide ground protection for the electrical components and circuitry of the lamp.

Moreover, the user is not prevented from inadvertently installing the three-pin lamp ends in a conventional, non-grounded tombstone holder rather than the grounded counterpart replacement holders proposed by Ham. Doing so results in a non-grounded lamp, although visually the installation looks nearly identical to a properly grounded lamp. There is no reliable means of assuring that the holders are replaced and the installation properly performed, and it is difficult to determine by visual inspection whether an installation was performed properly to create a safe grounded system. It is impractical to disassemble the system to check that the conventional fluorescent lamp holders were replaced with grounded lamp holders and that ground straps were connected to the system ground. This presents a significant difficulty for end users, lighting maintenance personnel, building inspectors, safety regulators and others desiring to confirm that replacement LED tube lamps are safely grounded. These difficulties are even more pronounced in commercial environments, such as retail space, warehouses and office buildings, whose overhead lighting systems may utilize hundreds or even thousands of linear tube lamps.

An alternative snap-fit connector system adapted for LED linear tubes is shown in U.S. Patent Application Publication 2014/0293595, by the same applicant of the subject application, and is incorporated as if reproduced in its entirety herein. The tubular LED lighting assembly has at least one LED emitter board within the body; and first and second connectors respectively at the first and second body ends that are configured to secure the lamp on a support fixture. The first connector has cooperating first and second parts. The first connector part is integrated into an end cap assembly of the lamp body. The second connector part is configured to be on a support for the tubular lighting assembly.

The first and second connector parts respectively have first and second surfaces. As the second connector parts connector part is received within an opening of the end cap assembly, the first and second surfaces are placed in confronting relationship to prevent separation of the first and second connector parts as an incident of the first connector part moving relative to the second connector part from a position fully separated from the second connector part in a substantially straight path that is transverse to the length of the lamp body. The snap-fit connection does not utilize exposed pins to mechanically secure the lamp ends to the support and is effected by a linear motion rather than an insert and rotate technique. The first end cap assembly includes at least a first connector board. The connector board comprise generally L-shaped pins housed within the end cap assembly, each having a first portion extending in a direction generally parallel to the length of the body and a second portion extending in a direction traverse to the length of the body and towards the second connector part when said first connector part is moved towards the second the second connector part and into the engaged position. The conductive components on each of the first and second connector parts electrically connect to each other to form an electrical path between the illumination source and an external power supply as an incident of the connector parts being moved into the snap-fit engaged configuration.

The above-mentioned snap-fit connector system addresses some of the problems associated with the use of conventional tombstone type lamp holders for securing LED tube lamps to lighting fixtures. However, it maintains the LED tube lamp in an operating state without providing a means for ground protecting the LED tube heat sink or the internal electrical components of the lamp, thus creating safety and reliability issues for the lamp installation. There is a need for a connector system designed for the unique needs of LED lamp technology that alleviates all safety concerns and provides a safe, reliable and convenient solution that will allow the benefits of LED lamp technology to be fully realized and can be implemented in a cost-effective manner.

DESCRIPTION OF THE PREFERRED EMBODIMENTS

Figure 1:
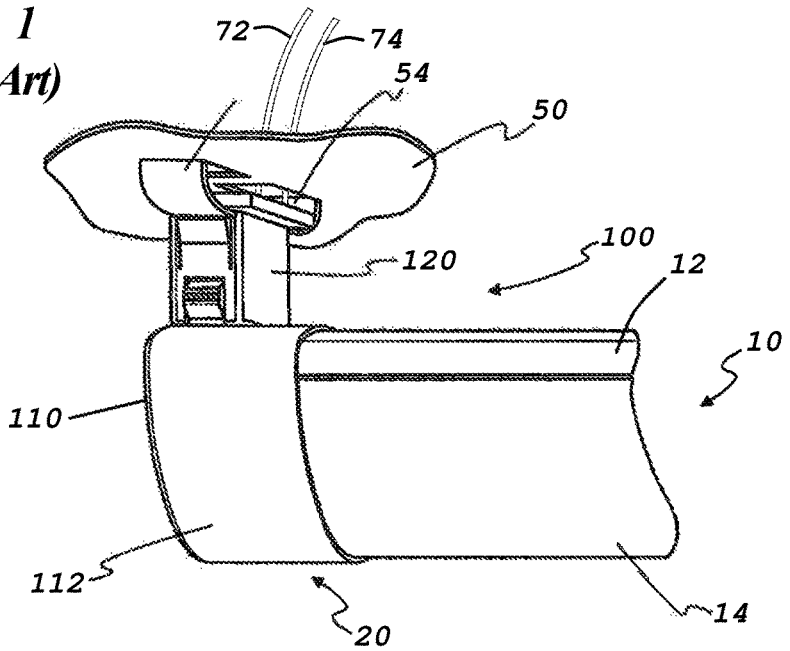
FIG. 1 (Prior Art)
FIG. 1 is a fragmentary, perspective view of an elongate tubular lighting assembly, and showing cooperating connector parts at one end of a body on or within which there is a source of illumination.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated devices, and such further applications of the principles of the invention as illustrated herein are contemplated as would normally occur to one skilled in the art to which the invention relates.

There is a need for an improved lamp holder and connector system that address all safety issues and provides a grounded LED lighting system in the linear tube format that is widely deployed throughout the lighting industry. As used herein, the terms "LED tube lamp" and "linear LED lamp" and similar variants are used interchangeably to describe LED lamps having at least one LED board mounted on an externally exposed heat sink having a narrow and elongated overall profile and with optional elongated optical lens, and designed for removable mounting to a variety of lighting fixture housings. While the overall form factor of such lamps is ordinarily generally similar to that of conventional fluorescent tube lamps, the use of these terms is not intended to limit the scope of the disclosed or claimed subject matter to lamps having any particular lateral cross-sectional shape or to require a fully enclosed outer tubular structure.

FIGS. 1 to 7 illustrate an available snap-fit connector system for linear LED tube lighting. The lamp comprises an elongate tubular body portion 10 including a metallic heat sink 12 extending throughout a generally upward facing portion of the circumference of the tubular body, and a transparent or translucent lens portion 14 extending throughout a generally downward facing portion of the circumference of the tubular body. The heat sink is preferably formed of an aluminum alloy, although other thermally conductive materials may be used. At least one LED emitter panel comprising a printed circuit board mounting a series of LEDs is mounted to the heat sink internal to the tubular body. Heat generated by the LEDs conducts through the emitter panel to the heat sink. The heat sink of the illustrated lamp is multi-sided with a generally triangular cross-sectional geometry in a plane perpendicular to the length of the lamp body, providing two mounting surfaces for supporting multiple LED emitter panels in a V-orientation. End cap assemblies disposed at the opposite lamp ends have a corresponding triangular cross-section in a plane perpendicular to the length of the body.

Figure 2:
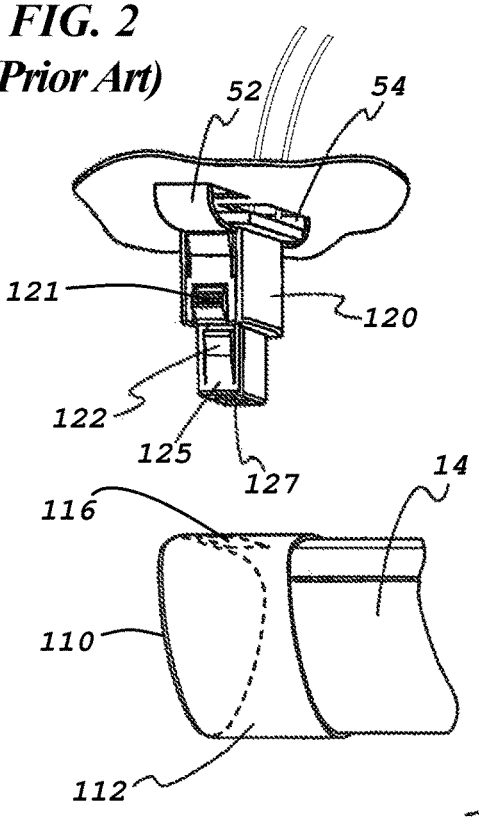
FIG. 2 (Prior Art)
FIG. 2 is a view as in FIG. 1 with the connector parts fully separated from each other.
Figure 3:
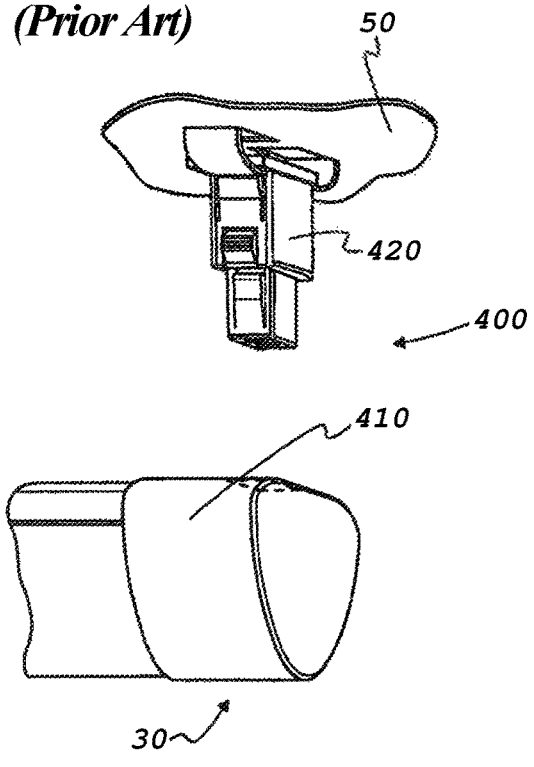
FIG. 3 (Prior Art)
FIG. 3 is a view as in FIG. 2 showing cooperating connector parts at the opposite end of the body.

The available system mechanically secures the LED tube lamp to a support and electrically connects it to an external power supply, but leaves the lamp heat sink and internal electronic components in an ungrounded state. As can be seen in FIGS. 1-3, a first connector 100 at the first end 20 of the body 10 is made up of a first connector part 110 and a second connector part 120. A second connector 400 is provided at the second end 30 of the body 10 and is made up of a third connector part 410 and a fourth connector part 420. The body of the connector parts are formed of plastic or other non-conductive material and are preferably manufactured using conventional injection molding techniques.

The first and second connectors 100, 400 are configured to maintain the body 10 in an operative state on a support 50 that may be in the form of a reflector, or otherwise configured. The first connector part 110 is part of a first end cap assembly 112 that is provided at the first body end 20. The second connector part 120 is provided on the support/reflector 50. The third connector part 410 is provided at the second end 30 of the body 10, with the fourth connector part 420 provided on the support/reflector 50. The body includes at least one LED emitter panel providing a source of illumination, which is electrically connected to a power supply through the first connector 100.

Figure 4:
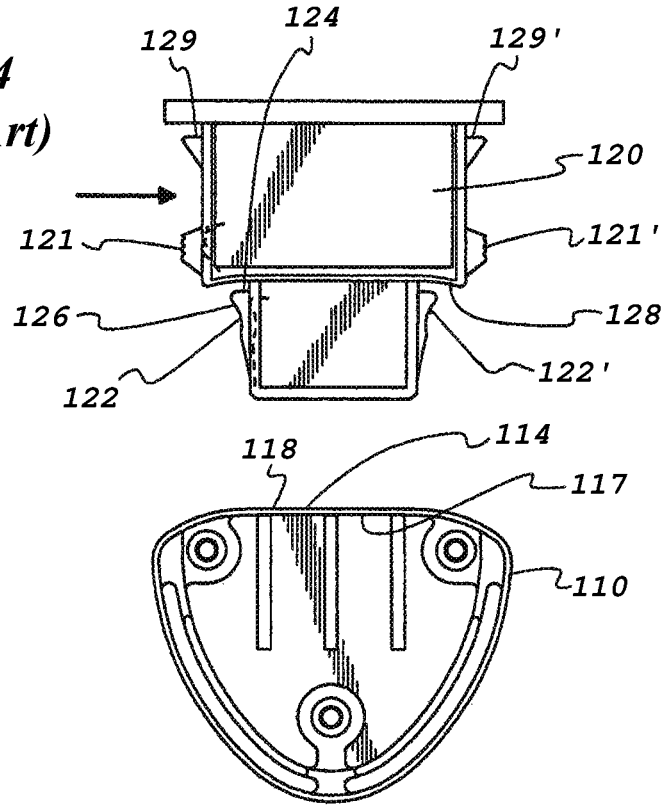
FIG. 4 (Prior Art)
FIG. 4 is an enlarged, end view of the connector parts shown in the relationship of FIG. 2.

As shown in FIG. 4, second connector part 120 has oppositely opening slots 129, 129'. The slots cooperate with the reflector tabs 52, 54 as illustrated in FIG. 1. That is, the tabs 52, 54 are formed so that they can slide through the slots 129, 129' whereby the second connector part 120 and support/reflector 50 can be press connected starting with these parts fully separated from each other. A simple sliding movement lengthwise of the body 10 will fully seat the tabs 52, 54 that become frictionally held in the slots 129, 129'. The fourth connector part 420 also includes slots that provide for releasable connection to tabs of the support/reflector 50 in substantially the same way.

Figure 6:
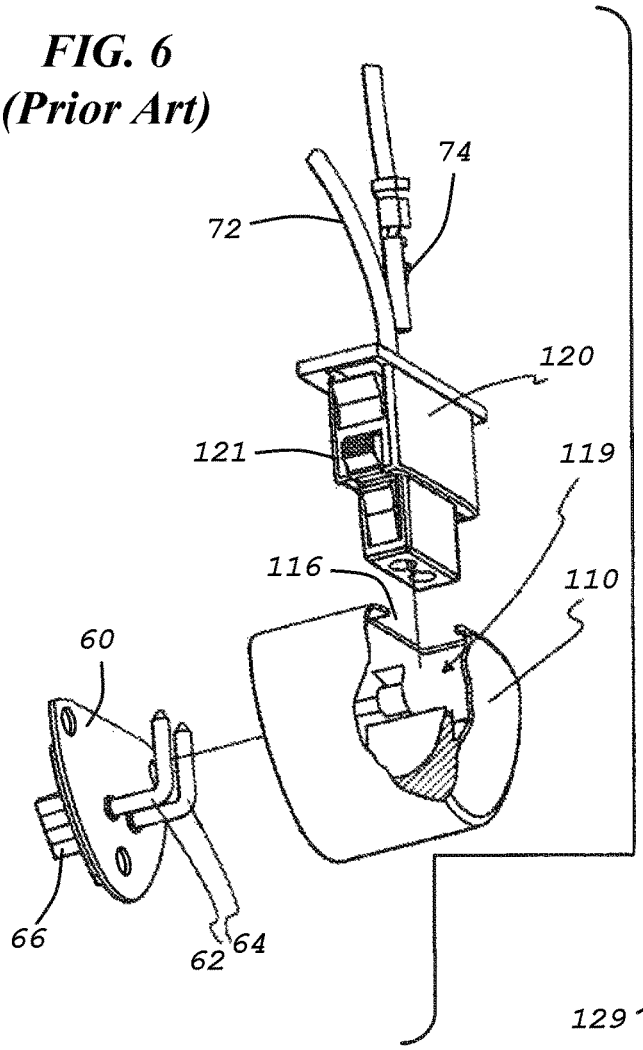
FIG. 6 (Prior Art)
FIG. 6 is an exploded, perspective view of an end cap assembly consisting of the connector parts in FIG. 2 and a connector board for the source of illumination.
Figure 7:
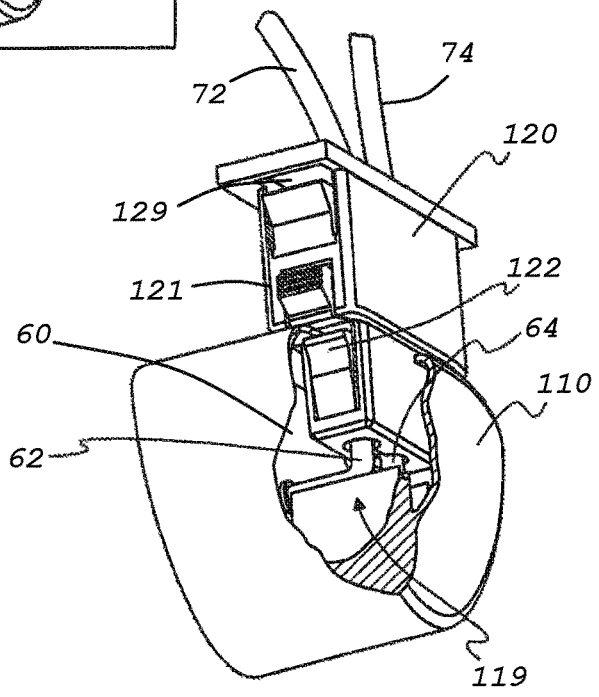
FIG. 7 (Prior Art)
FIG. 7 is a view as in FIG. 6 with the parts assembled.

As shown in FIGS. 1, 6 and 7, first end cap assembly 112 which forms the first connector part 110 consists of a first, cup-shaped receptacle 119 into which the first end of the body extends. The first end cap assembly 112 is shaped to accommodate a multi-sided heat sink having a generally V-shaped cross-section for supporting multiple LED emitter boards, and an internal driver board. Other end cap and heat sink configurations are possible.

Figure 5:
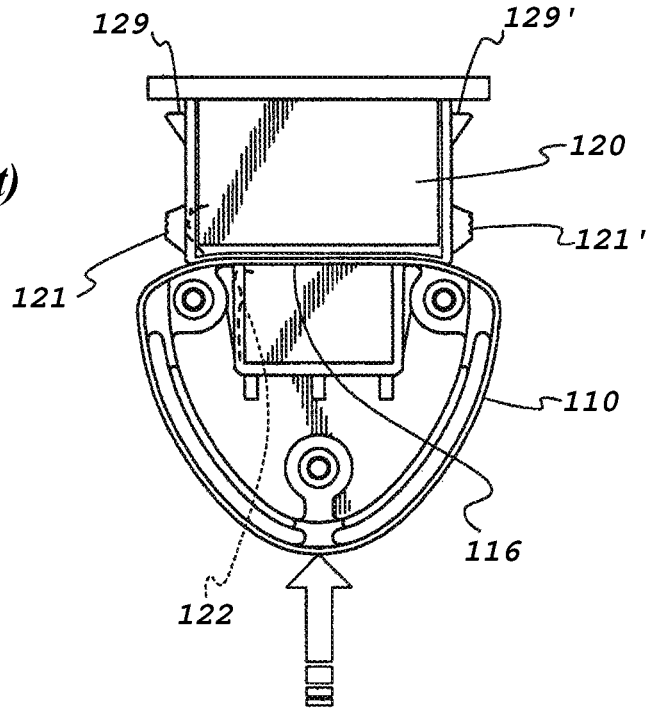
FIG. 5 (Prior Art)
FIG. 5 is a view as in FIG. 4 with the connector parts joined in an assembled configuration.

In FIG. 4, the first connector part 110 is shown in a position fully separated from the second connector part 120. In FIG. 5, the first connector part 110 is shown moved relative to the second connector part 120 from the fully separated position in a substantially straight path, as indicated by the upward pointing arrow, transverse to the length of the body 10, into the engaged upward facing wall 114 bounded by an edge. Second connector part 120 has a first bendable part 122. The second connector part 120 is configured so that the first bendable part 122 is engaged by the edge of the opening 116 and progressively cammed from a holding position, as shown in solid lines in FIGS. 4 and 5, towards an assembly position, as shown in dotted lines in each of FIG. 4 and FIG. 5, as the lamp end 20 and first connector part 110 is moved upward to and into the engaged position. The first bendable part 122 moves from the assembly position back towards the holding position with the first part realizing the engaged position.

The first connector part 110 has a wall 114 through which the opening 116 is formed. A first surface 117 is a portion of the inner surface of this wall 114. A second surface 124 is defined by a boss 126 on the bendable part 122. The wall 114 has a third surface 118 on its opposite surface that faces towards a fourth surface 128 on the second connector part 120. The wall 114 resides captively between the second and fourth surfaces 124, 128 with the first connector part 110 in the engaged position to maintain this snap-fit connection.

As can be seen in FIG. 2, first bendable part 122 is joined to the leading end 127 of the second connector part 120 through a live hinge 125. The second connector part 120 has an actuator 121, in this embodiment on the first bendable part 122 remote from the hinge 125, that can be pressed in the direction of the horizontal arrow in FIG. 4 with the first connector part 110 in the engaged position, thereby to move the first bendable part 122 towards its assembly position, as shown in dotted lines in FIGS. 4 and 5, to allow the surface 124 to pass through the opening 116 so that first connector part 110 can be separated from the second connector part 120. The second connector part 120 has a second bendable part 122' on an opposite side that is configured the same as the first bendable part 120 and cooperates with the edge of opening 116 in the same way that the first bendable part 120 cooperates with the edge in moving between corresponding holding and assembly positions. An actuator 121' is situated so that the installer can grip and squeeze the actuators 121, 121', as between two fingers, towards each other, thereby changing both bendable parts 122, 122' from their holding positions into their assembly positions.

The second connector 400 has third and fourth connector parts 410, 420 that are respectively structurally the same as the first and second connector parts and interact with each other mechanically at the second end 30 of the body 10 in the same way that the first and second connector parts 110, 120 interact with each other at the first end 20 of the body. The first and second connectors 100, 400 are configured to maintain the body 10 in an operative state on a support 50 that may be in the form of a reflector, or otherwise configured.

In the embodiment shown, at least the first end 20 of the LED tube lamp is adapted to receive power from an external power supply. As shown in FIGS. 6 and 7, the receptacle 119 may receive an end connector board 60 having L-shaped electrical connector terminals 62, 64 thereon that cooperate with connector assemblies 72, 74 having wires that extend through second connector part 120 to establish electrical connection between the board 60 and the power supply. The connector terminals 62, 64 may be mechanically and electrically connected to the board 60, and the board includes traces to form electrical paths from the connector terminals 62, 64 to terminals such as terminals 66. The terminals 66 cooperate with pins extending from LED emitter boards, driver circuit boards or other electrical components to provide power to such components. Alternatively, the connector terminals 62, 64 may electrically connect to the LED emitter boards and/or other electrical components of the LED lamp system via one or more wires. The L-shaped electrical connector terminals 62, 64 of connector board 60 each have a first portion extending in direction generally parallel to the length of the body and a second portion extending in a direction traverse to the length of the body and towards the second connector part 120. When said first connector part 110 is moved towards the second the second connector part and into the engaged position, the first and second connector parts 110, 120 can be mechanically snap-connected, and connector assemblies 72, 74 are also press fit into electrical connection with the connector terminals 62, 64 as an incident of the first connector part 110 moving from its fully separated position into its engaged position.

Figure 8A:
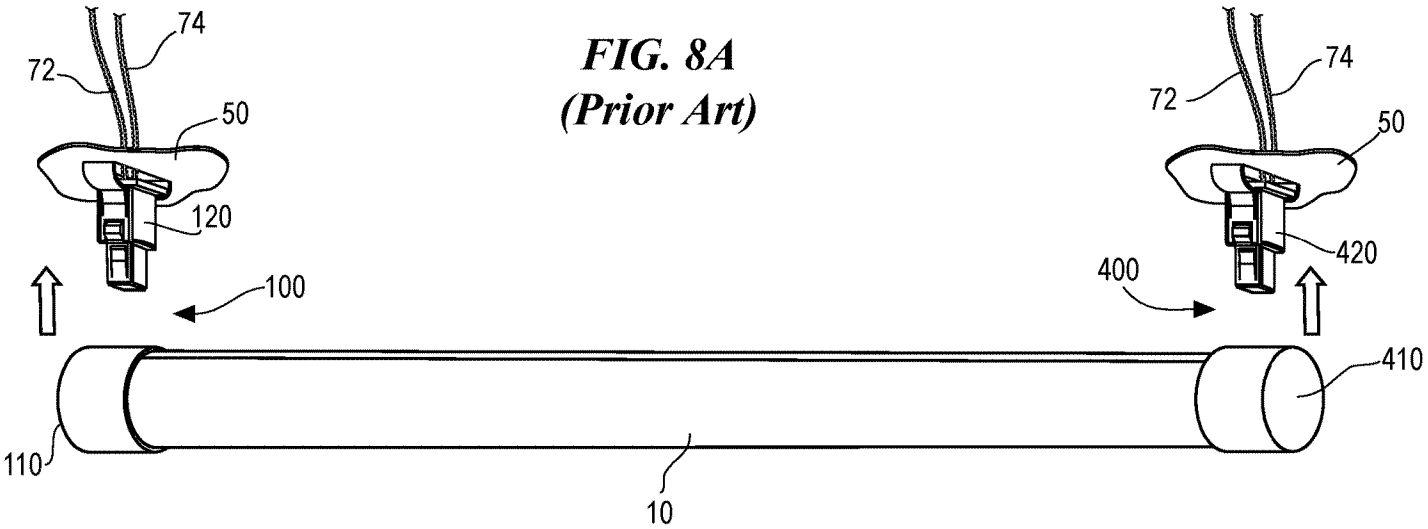
FIG. 8A (Prior Art)
FIG. 8*a* is a perspective view of tubular lighting assembly, and showing cooperating connector parts at each end of the body configured to connect to an external power source at each end of the body.
Figure 8B:
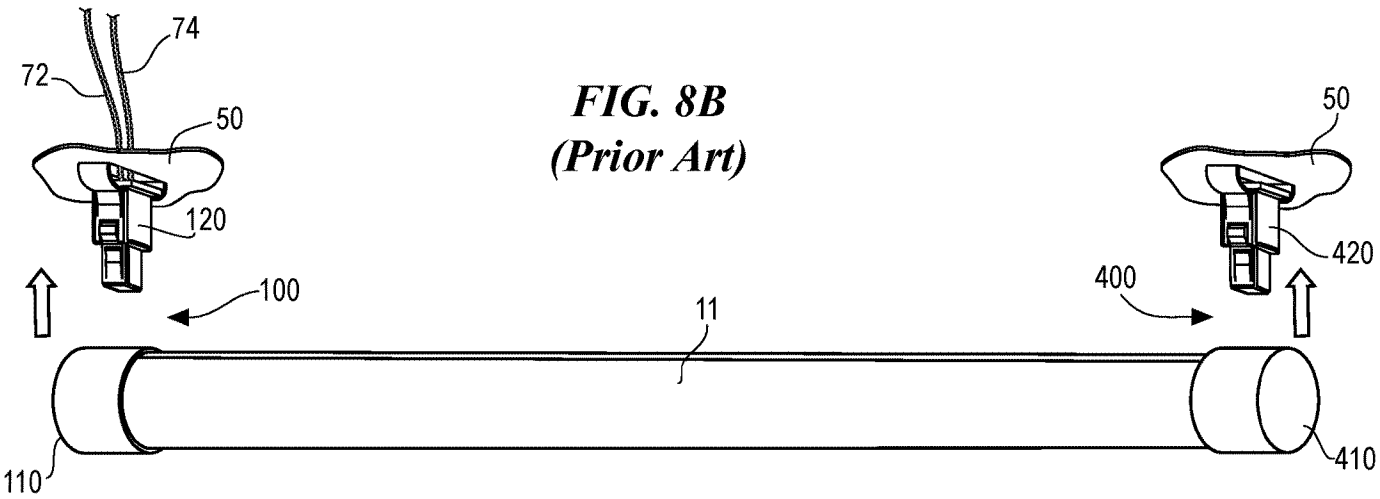
FIG. 8B (Prior Art)
FIG. 8*b* is a perspective view of tubular lighting assembly, and showing cooperating connector parts at each end of the body, with one set of cooperating connector parts configured to connect to an external power source.

FIG. 8*a* illustrates an installation using a snap-fit connector system of this type in which power is supplied to both ends of the linear LED tube lamp body 10. In FIG. 8*a*, the connector is shown for a linear LED tube lamp of a generally circular cross-section. Snap-fit connectors 100 and 400 are provided at opposite ends of the lamp comprising first and second connector parts 110, 120 and third and fourth connector parts 410, 420 respectively. The depicted lamp is designed to be connected to and receive power from an external power supply at both lamp ends, as shown in FIG. 8*a*. The connector system components at each end of the lamp thus includes both the mechanical and electrical connector components described above. Some LED lamps are configured to connect to the external power supply at only one end. As illustrated in FIG. 8*b*, for a lamp of this type shown as lamp 11, the second connector 400 may include only the components needed to mechanically connect third connector part 410 of second end cap assembly to fourth connector part 420. In other words, the second end cap assembly and the fourth connector part 420 need not include electrical connector terminals and may be provided without a means for connecting to the power supply.

The connector systems described thus far for powering the internal components of the lamp leave the internal components, and the externally exposed lamp heat sink, in an ungrounded condition. There is a risk of damaging the internal components in the event of a power surge, and the heat sink presents a potential electric shock risk and/or fire hazard if applied power leaks to the heat sink as a result of a short circuit condition.

Figure 9:
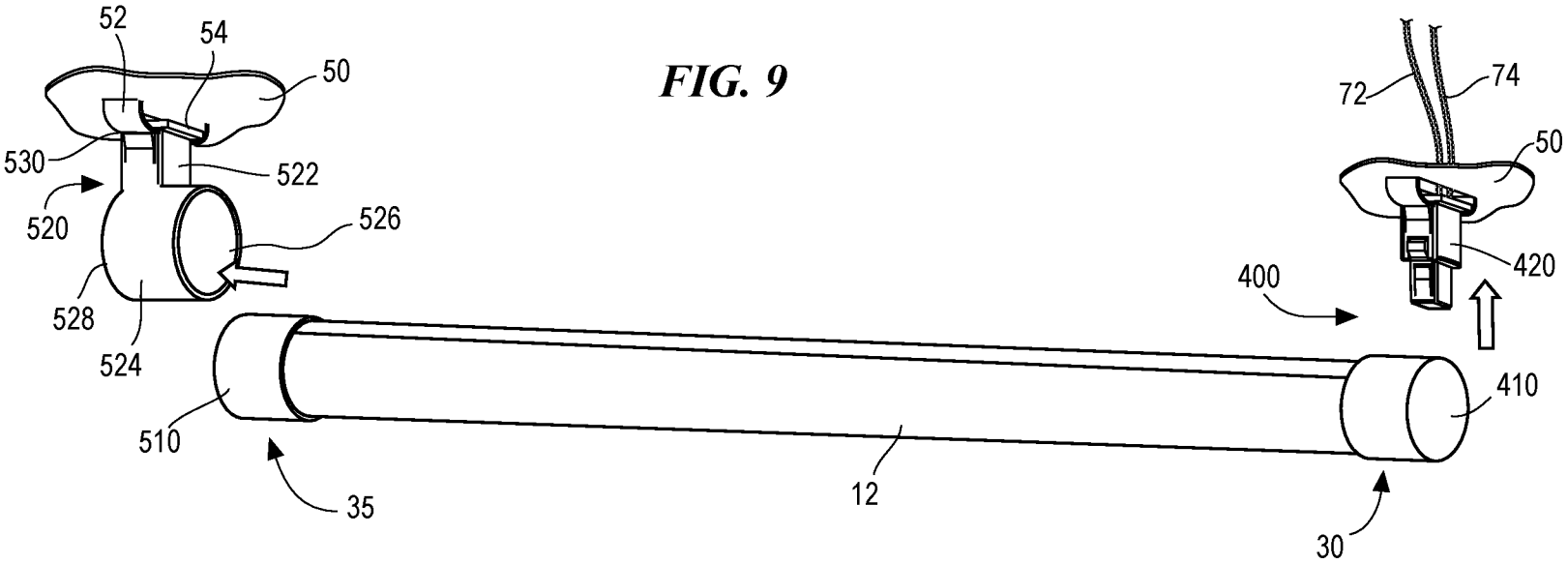
FIG. 9 is a perspective view of tubular lighting assembly, and showing cooperating connector parts at one end of the body, configured to connect to an external power source and a connector sleeve at the other end of the body.

FIG. 9 illustrates an alternative, improved connector system adapted for single end power linear LED tube lamps in which only one end of the lamp is configured to connect to and receive power from an external power supply. In this system, the end 30 of the LED tube lamp 12 shown, is adapted to receive power through connector assemblies 72 and 74. It is secured to support 50 by means of connector 400 consisting of third connector part 410 having an opening in its sidewall and fourth connector part 420 having moveable components for making a snap-fit connection with the sidewall, as described above with reference to the FIGS. 1 to 7 and 8*a*. The opposite end 35 of lamp 12 includes an end cap assembly 510 of cylindrical shape having a receptacle into which the second end of lamp 12 inserts. The end cap assembly 510 need not include an opening in its side wall, as it does not engage a male snap-fit connector part of the type depicted as fourth connector part 420 for securing the first lamp end 30.

The system further includes plastic connector sleeve 520, which is adapted to mount to support 50. A base portion 522 of connector sleeve 520 includes slots 530 on opposite sides thereof into which tabs 52, 54 of support 50 slide so that connector sleeve 520 can be secured to support 50. The base portion 522 extends toward sleeve portion 524 comprising a continuous sidewall 526 and end wall 528, which form a receptacle having an open end facing towards the opposite fourth connector part 420 and sized to receive the second end cap assembly 510 of the LED lamp. The sleeve portion 524 is preferably of a cross-sectional shape that conforms to the cross-sectional shape of end cap assembly 510, which is circular in the illustrated embodiment. Connector sleeves comprising a sleeve portion of other cross-sectional geometries, such as generally triangular, square or rectangular, are also contemplated for use with other lamps having corresponding end cap cross-sectional geometries. In one preferred form, the sleeve forms a receptacle of a generally triangular cross-section for receiving a generally triangular end cap assembly of a lamp comprising a multi-sided heat sink mounting multiple LED emitter boards such as the lamp illustrated in FIGS. 1 to 3.

FIG. 9 shows the fourth connector part 420 of connector 400 and connector sleeve 520 mounted to support 50 at opposite ends of a light fixture. LED tube lamp 12 may be installed in the fixture by inserting the end cap assembly 510 at the end 35 linearly along the length of the lamp body in the direction of the horizontal arrow into the receptacle of connector sleeve 520. The connector sleeve is preferably sized so that end cap assembly 510 is easily guided into the receptacle, where it is supported in the vertical direction yet adjustable in the horizontal direction. Next, the third connector part 410 of the end cap assembly at the opposite end 30 is adjusted so that its opening is aligned with the fourth connector part 420. In the case of a cylindrical lamp, this may also require rotating the lamp about its longitudinal axis to radially aligning the female opening of third connector part with the male portion of fourth connector part at the power end. The third connector part is then moved upward in the direction of the vertical arrow towards fourth connector part 420 so as to guide the fourth connector part 420 into snap-fit connection with third connector part 410. Securing the snap-fit connection at the power end 30 of the lamp locks the lamp at its proper rotational orientation and prevents the lamp from backing out linearly from connector sleeve 520, and the lamp is thus securely maintained in an operational state. To remove an installed lamp, the snap-fit connection may be released using the actuators as previously described, which allows withdrawing the end cap assembly 510 at end 35 from the receptacle of connector sleeve 520.

This connector system offers potential advantages compared to the alternative approach of deploying a power enabled snap-fit connector at the power end of the lamp and modified no power snap-fit connector at the opposite no power end. It eliminates the need to manufacture and distribute alternative versions of the snap-fit connector for power and no power applications. It also facilitates simplification of LED tube lamp design, as the no power end 35 requires only a simple end cap without any modifications to accommodate a snap-fit connection system or external bi-pin terminals adapted for conventional tombstone lamp holders. The connector sleeve 520 is easily manufactured and contains no moving parts.

Moreover, the sleeve 520 provides convenience to the lamp installer and a more efficient installation methodology. With standard linear LED tube lamps typically ranging from 2 to 8 feet in length, it is cumbersome to properly align the cooperating components into the proper engaged position while handling a portion of the lamp that is significantly displaced from the lamp end being installed. Thus, lamp installation typically requires the installer to grasp a first end of the lamp and position it into engagement with its corresponding lamp holder, whether a snap-fit connector or rotating tombstone lamp holder, and then move to a position proximate the opposite end of the lamp to manipulate the opposite end into engagement with its lamp holder. Using the connector sleeve 520, however, both ends of the lamp may be installed by manipulating the lamp from the power end. While grasping the lamp near the power end 30, the installer may guide the opposite no power end 35 into the receptacle opening of connector sleeve 520. This requires only minimal dexterity and skill compared to the more precise positioning and controlled movements needed to guide the components of the snap-fit or tombstone type connector system together. After the no power end is seated in the receptacle of the connector sleeve, the installer may adjust the linear and angular position of third connector part 410 at the power end 30 as necessary to align its connector opening with fourth connector part 420 while the opposite end 35 remains seated in the connector sleeve. While remaining at the same location, the installer then moves the lamp end 30 directly upward from the separated position and into snap-fit engagement with fourth connector part 420 pre-mounted on support 50. Potentially significant time and associated labor savings may be achieved with this system and installation method, especially in commercial environments requiring installation of hundreds or potentially thousands of LED tube lamps.

Figure 10:
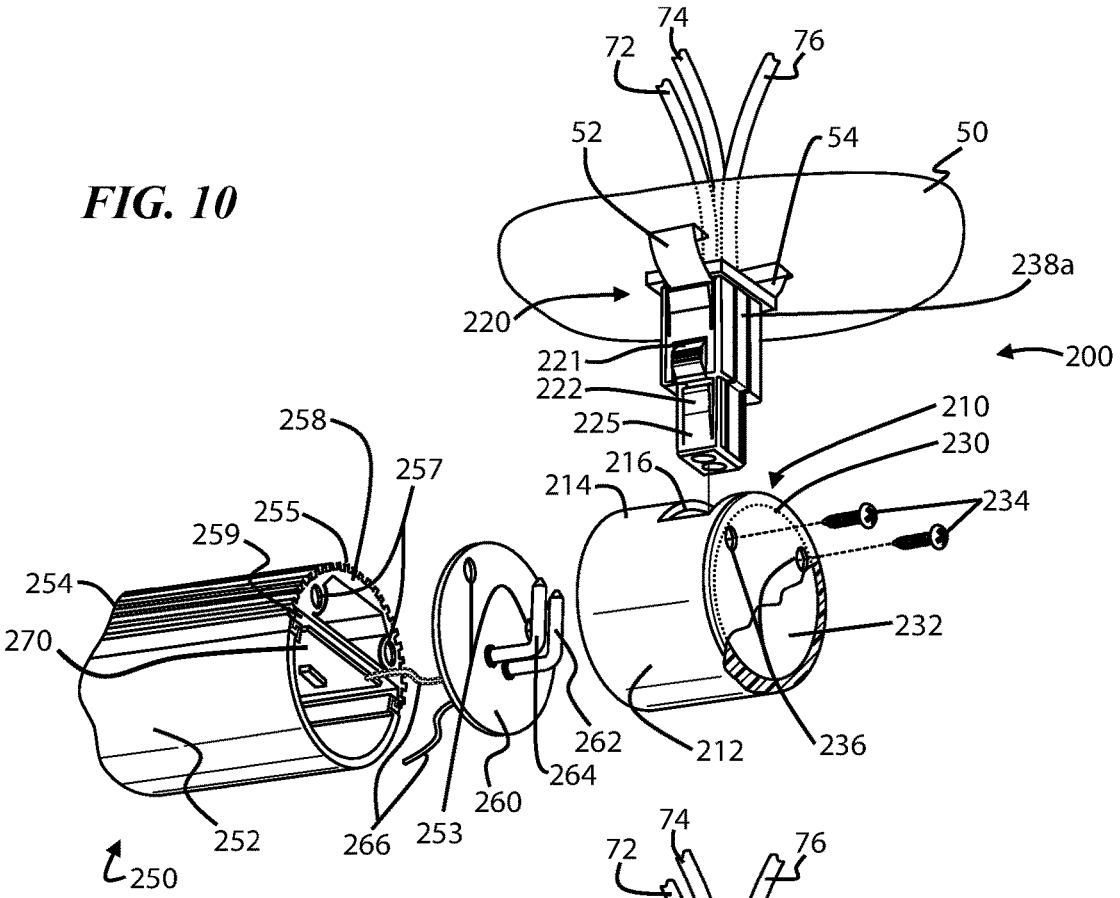
FIG. 10 is a fragmentary, perspective view of an elongate tubular lighting assembly, and showing cooperating connector parts at one end of a body and including cooperating ground protection components.

With connector systems suitable to mechanically and electrically connect linear LED tube lamps to a support having thus been described, the following discloses improved connector systems capable of providing ground protection to the lamp heat sink and/or internal electronic components. FIG. 10 is directed to a snap-fit connector system for a linear LED tube lamp that includes an integrated grounding system for providing ground protection to the LED tube heat sink. LED tube lamp 250 comprises an elongate tubular body portion including a metallic heat sink 254 extending throughout a generally upward facing portion of the circumference of the tubular body, and a transparent or translucent lens portion 252 extending throughout a generally downward facing portion of the circumference of the tubular body. The heat sink is preferably formed of an aluminum alloy, although other thermally conductive materials may be used. At least one LED emitter panel 270 comprising a printed circuit board mounting a series of LEDs is mounted to the heat sink internal to the tubular body. Heat generated by the LEDs conducts through the emitter panel to the heat sink. The heat sink may include fins 255 extending along its length to increase the effective surface area for transfer of heat to the atmosphere. The LED lamp 250 may include an internal ballast or driver module or may alternatively utilize an external ballast associated with the lighting fixture. Heat sink 254 has a generally semi-circular cross-section in a plane perpendicular to the length of the lamp, with support wall 259 extending across the internal region thereof to provide a mounting surface for LED emitter panel 270. Other heat sink geometries are also contemplated, including, for example, a configuration such as the one illustrated in FIG. 13 comprising multiple support walls arranged in a generally V-shape and lying in intersecting planes for supporting multiple LED emitter panels arranged to distribute light over a wide area.

With further reference to FIG. 10, LED lamp 250 is mounted at its first end to a support 50 of a lighting fixture by means of snap-fit connector system 200 comprising first connector part 210 and second connector part 220. Several aspects of the components of the snap-fit connector system of FIG. 10 for securely connecting LED lamp 250 to support 50 are substantially the same structurally as described above with reference to the snap-fit system illustrated in FIGS. 1-7. Thus, second connector part 220 is provided on the support/reflector 50. The support 50 may be a reflector portion of an existing ceiling lighting fixture of the type conventionally used for linear fluorescent tube lighting. The connector system of the invention may be utilized in other types of lighting fixtures secured to an overhead ceiling grid or to another structure. The LED emitter panel 270 providing a source of illumination is electrically connected to a power supply through the connector system 200. The second connector part 220 can be press connected to the support 50 by means of oppositely opening slots that cooperate with the support tabs 52, 54. Of course other releasable, and potentially permanent, connections are contemplated.

The first connector part 210 is part of a first end cap assembly 214 that is provided at the first end of LED lamp 250. The first end cap assembly 214 is formed of plastic or other non-conducting material and comprises cylindrical side wall 212 extending from circular end wall 230. First end cap assembly 214 forms a cup-shaped receptacle into which the first end of the body of LED lamp 250 extends. An opening 216 is formed in side wall 212 to receive a portion of second connector part 220.

The second connector part 220 has a pair of bendable parts 222 on opposite sides thereof, each operable through hinge 225, which are engaged by the edge of the opening 116 and progressively cammed from a holding position towards an assembly position as the first connector part 210 is moved up to and into the engaged position. The first bendable parts 222 move from the assembly position back towards the holding position with the first part realizing the engaged position. The wall 214 resides captively between surfaces of the first connector part 210 in the engaged position to maintain this snap-fit connection. A pair of actuators 221 on opposite sides of second connector part 220 can be pressed to move the first bendable parts 222 towards its assembly position, in the same manner shown in dotted lines in FIGS. 4 and 5, to allow them to pass through the opening 216 so that first connector part 210 can be separated from the second connector part 220.

As FIG. 10 illustrates, the receptacle of end cap assembly 214 may receive an end connector board 260 having L-shaped electrical connector components 262, 264 thereon that cooperate with connector assemblies 72, 74 having wires that extend into the second connector part 220 and connect to a power supply. The connector components 262, 264 may connect to LED emitter board 270 by means of wires 266 and may similarly provide power to other internal components of LED tube lamp 250. In one aspect, wires 266 connect to an internally mounted driver module to provide AC line voltage which the driver module converts to DC voltage supplied to the LED emitter board and optionally other internal componentry. Although the embodiment illustrated in FIG. 10 utilizes internal wire connections, the end connector board 260 may alternatively be in the form of a printed circuit board (PCB) connector containing male or female electrical terminals for connecting to corresponding terminals associated with LED emitter board 270, a driver circuit or other internal components of the lamp to provide a no-wire design. In both approaches, connector components 262, 264 provide an electrical path over which electrical power from a power supply is provided to the LED emitter board 270 and optionally other internal components. The L-shaped electrical connector components 262, 264 on the connector board 260 each have a first portion extending in direction generally parallel to the length of the body and a second engagement portion extending in a direction traverse to the length of the body and towards the second connector part 220 when said first connector part 210 is moved towards the second the second connector part and into the engaged position.

Heat sink 254 has a planar end face 258 at a first end thereof defining a pair of apertures 257. Connector end board 260 includes a pair of corresponding apertures 253 aligned with heat sink apertures 257. End wall 230 of first end cap assembly 214 defines corresponding aligned apertures 236. The end cap assembly 214 and end connector board 260 may be secured to heat sink 254 at the first end of LED tube lamp 250 with a pair of metallic fasteners 234 extending through the corresponding apertures and into the end face 258 of the heat sink. When assembled, the end board 260 and end portions of the heat sink and translucent lens portion 252 reside within the receptacle of end cap assembly 214.

Connector system 200 of this first embodiment of the invention comprises additional components that provide for grounding heat sink 254 as an incident of the snap-fit mechanical connectivity described above. In particular, second connector part 220 includes an integrated metal ground strap 238*a* mounted to a side surface thereof. The ground strap 238*a* extends from a base portion of second connector part 220 proximate the support 50 towards the distal leading end of second connector part 220 as shown. Ground strap 238*a* is mounted on the side surface of second connector part 220 that opposes end wall 230 of first end cap assembly 214 when the first connector part 210 and second connector part 220 are in the assembled configuration. Those skilled in the art will recognize a number of available techniques for mounting ground strap 238*a* to second connector part 220, including the use of mechanical fasteners, adhesives, mounting tabs or slots formed integral with second connector part 220, or using in laid injection molding techniques or any other available means. Ground strap 238*a* is connected at its proximal end to ground wire 76 via a connection internal to second connector part 220 (not shown).

First end cap assembly 214 is shown in FIG. 10 with a portion cutaway to better illustrate ground plate 232, which is mounted along the inner surface of end wall 230 of first end cap assembly. Ground plate 232 is of a conductive material, and defines apertures aligned with apertures 236 of end wall 230 for receiving the fasteners 234. The ground plate 232 may be mounted internal to first end cap assembly 214 by any available means, including by mechanical fasteners, adhesives, mounting tabs or slots formed integral with first end cap assembly, by means of in-laid injection molding techniques, or any other available means.

With the first end cap assembly 214 assembled to heat sink 254 as described, ground plate 232 is in electrical contact with the heat sink via the fasteners 234. At least a portion of ground plate 232 is of a thickness dimension such that when second connector 220 inserts through the opening 216 into the assembled position within first connector 210, a portion of the exposed conductive surface of ground plate 232 engages an opposing conductive surface of ground strap 238*a*.

Support 50 is grounded through mechanical connections to the ceiling infrastructure and/or via a connection to an isolated ground wire also providing grounding back to the dedicated ground bus of in input electrical power panel. Ground wire 76 may be connected to the support or to the ceiling infrastructure, or may be wired to a dedicated ground bus, to provide a grounding path for the snap-fit connector system and LED lamp. Thus, heat sink 254 is ground protected by the grounding path provided by the fasteners 234, ground plate 232, ground strap 238*a* and ground wire 76. This snap-fit connector system with integrated grounding electrically grounds the lamp heat sink to the externally grounded lighting fixture or other grounded system as an incident of the first connector 210 and second connector 220 being snap-fit into the fully engaged configuration, thereby eliminating the potentially hazardous condition associated with an ungrounded heat sink.

Ground strap 238*a* of the invention may be provided in various shapes, sizes and configurations adapted to establish the desired grounding connection in a wide range of available LED lamp end cap assemblies. In one aspect, ground strap 238*a* may extend further in the horizontal and/or vertical direction than depicted in FIG. 10 so as to directly engage the support 50 when the second connector part 220 is mounted to the support. In this alternative, the first connector part may form a direct mechanical ground connection with the support 50 without the use of ground wire 76.

Ground plate 232 may also be provided in various different forms other than the circular plate illustrated in the embodiment of FIG. 10. For example, ground plate 232 may be provided as a thin conductive clip mounted to the internal surface of end wall 230 and extending generally parallel and opposite ground strap 238*a* of second connector part 220. The plate may include a portion that protrudes away from end wall 230 and towards the ground strap 238*a* for contacting ground strap 238*a* of second connector part 220. It will be appreciated from the teachings herein, that various shapes, sizes and geometries of ground strap 238*a* and ground plate 232 can be utilized within the scope of the invention so long as these two components are adapted to come into physical contact with each other when the first connector part 210 and second connector part 220 of connector system 200 are moved into an engaged configuration.

Figure 11:
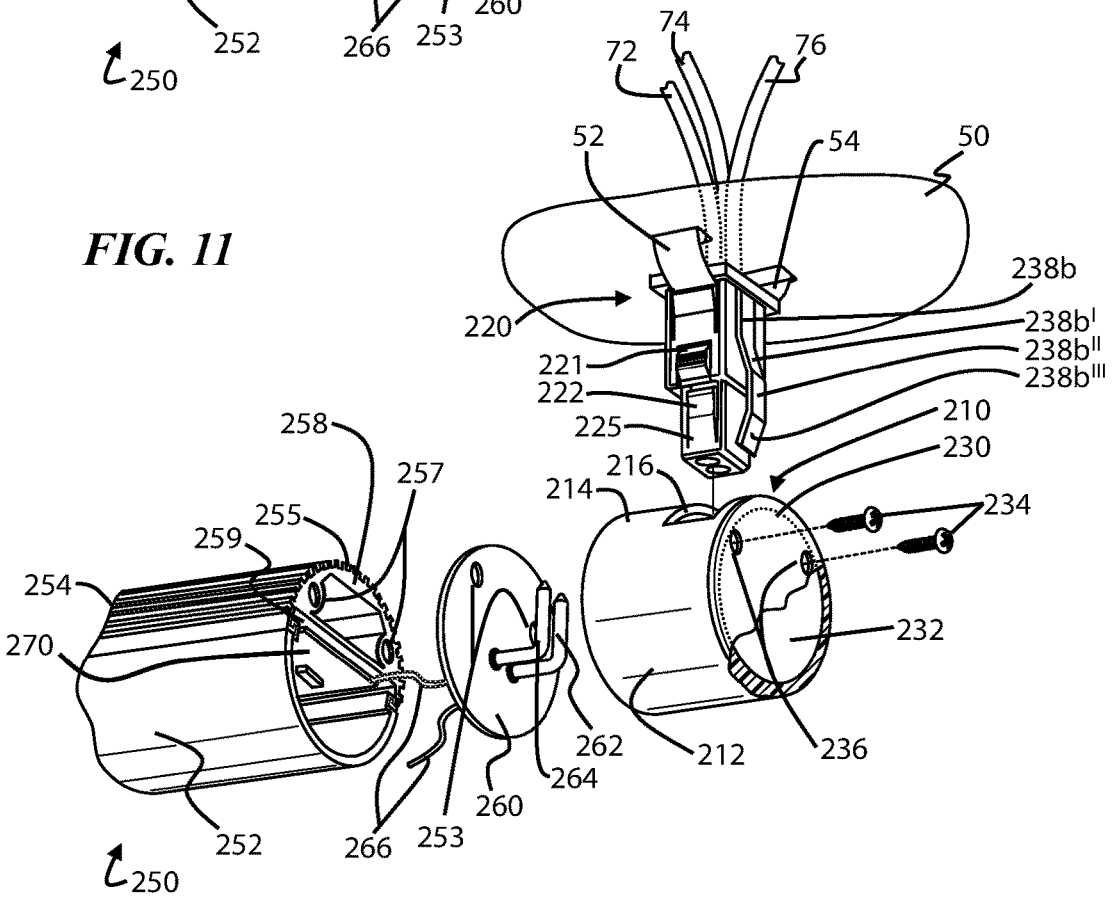
FIG. 11 is a fragmentary, perspective view of an elongate tubular lighting assembly, and showing cooperating connector parts at one end of a body and including alternative cooperating ground protection components.

FIG. 11 is directed to another embodiment of a ground protecting connector system to further illustrate possible ways of implementing the principles of the invention. The connector system of this embodiment is essentially the same in overall design and functionality as grounded connector system 200 of FIG. 10 except for the specific configuration of the ground strap. The structure and operation of like components is therefore not repeated. In particular, the ground strap 238*b* of this embodiment is secured at its proximal end to second connector part 220 and has an outwardly protruding profile. It includes a first ramp surface 238*b*' extending away from the side surface of second connector part 220, a mid-portion 238*b*" extending generally parallel to the side surface, and a terminal end portion 238*b*'" angled back slightly toward the side surface. When the first and second connector parts are in an engaged configuration, mid-portion 238*b*" engages the inner surface of ground plate 232 to complete a grounding path for the system. Ground strap 238*b* is preferably formed of a thin piece of spring steel having a high yield strength that allows it to be deformed and return to its original shape despite significant deflection. In the engaged configuration, ground plate 232 slightly compresses ground strap 238*b* from its relaxed shape such that its mid-portion 238*b*" is displaced towards the side surface of first connector part 220. The resulting spring force biases the mid-portion in the direction of and against the ground plate 232 to maintain secure contact between the mid-portion and the plate.

Figure 12:
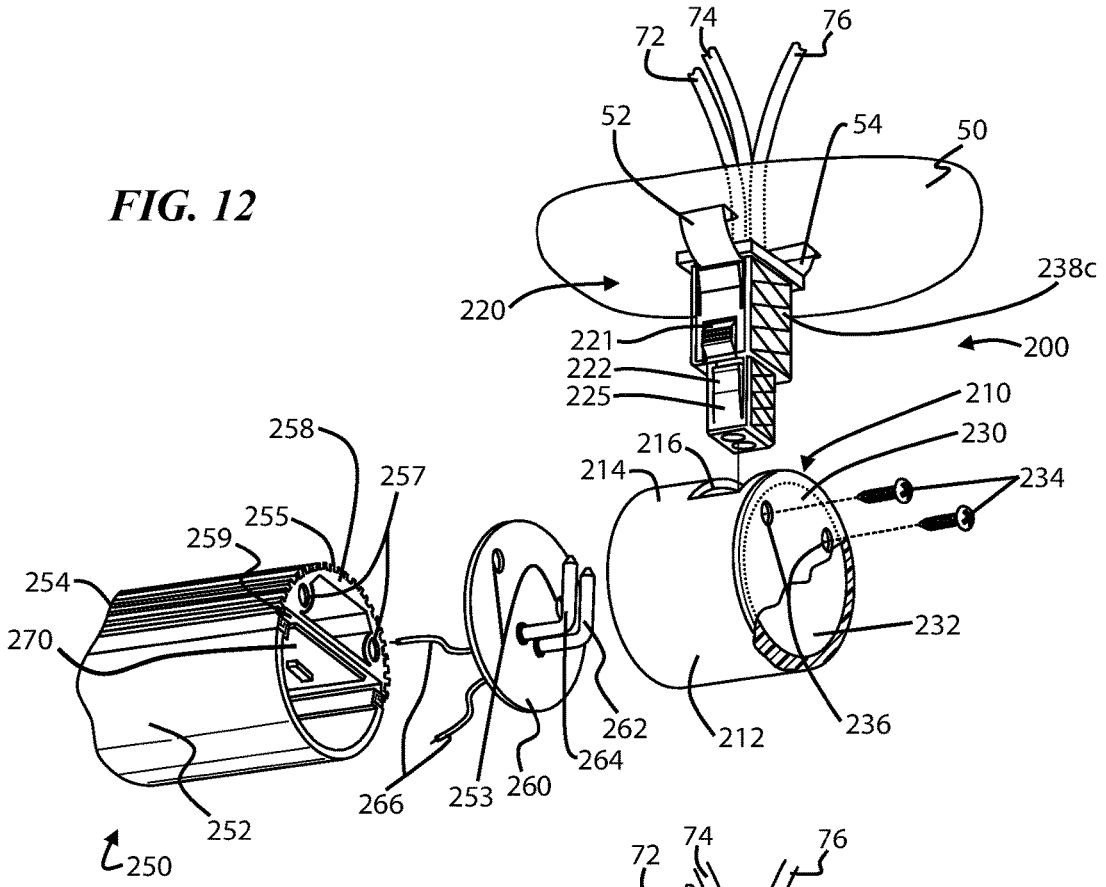
FIG. 12 is a fragmentary, perspective view of an elongate tubular lighting assembly, and showing cooperating connector parts at one end of a body and including alternative cooperating ground protection components.

Another embodiment of a grounded connector system in accordance with the principals of the invention can be seen in FIG. 12. The connector system of this embodiment is essentially the same in overall design and functionality as grounded connector system 200 of FIG. 10 except for the specific configuration of the ground strap. The structure and operation of like components is therefore not repeated. In particular, the ground strap 238*c* of this embodiment is provided as a thin wire mesh integrated into the side wall of second connector part 220 by utilizing an in-laid injection molding process. An outer surface of the wire mesh is exposed such that it engages and forms an electrical grounding path with a portion of the inner surface of end plate 232 of first connector part 210 when the connector components are in the engaged configuration. This embodiment may provide manufacturing advantages and results in the second connector part 220 having a thinner profile with no protruding components susceptible to being bent or damaged.

Figure 13:
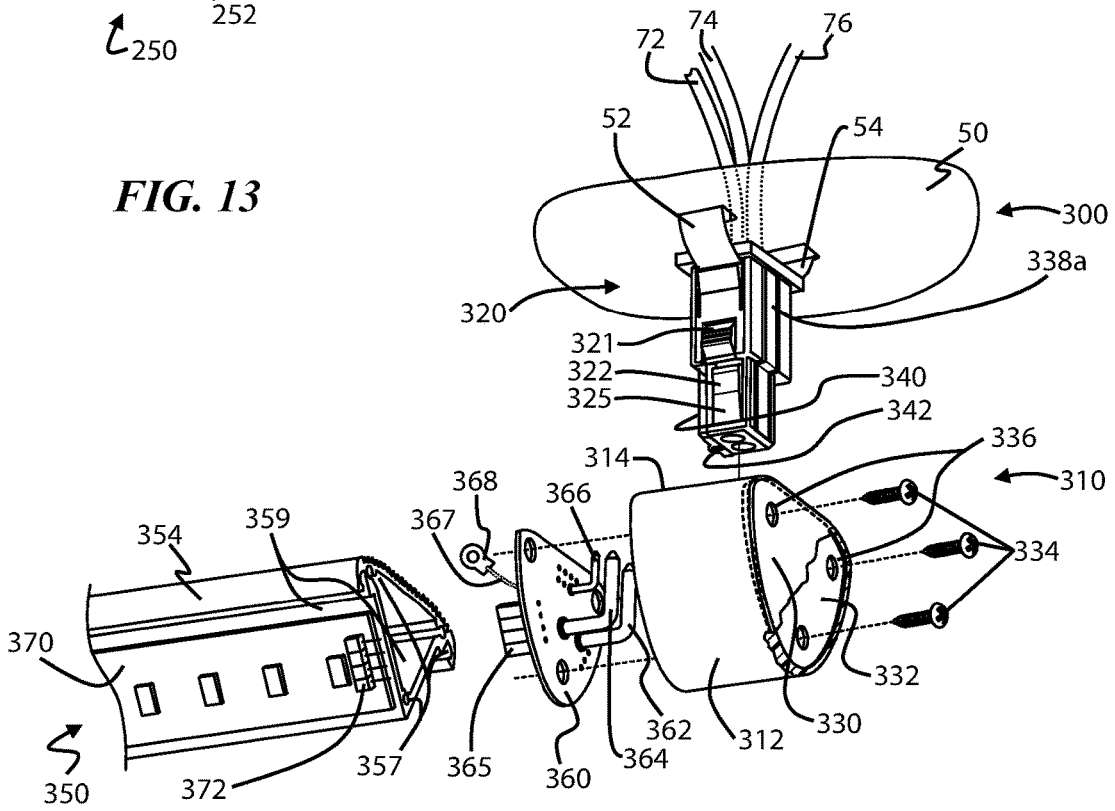
FIG. 13 is a fragmentary, perspective view of a multi-sided elongate tubular lighting assembly, and showing cooperating connector parts at one end of a body and including alternative cooperating ground protection components.

FIG. 13 is directed to another embodiment of the grounding system of the invention that can ground protect both the LED tube lamp heat sink and its internal LED emitter board and other internal electronic components. This embodiment is illustrated by reference to a LED tube lamp 350, which includes multi-sided heat sink 354 with a pair of support walls 359 having a generally V-orientation for supporting multiple LED emitter boards 370 facing different directions. Other components such as an internal driver circuit may also be mounted to the heat sink. The end connector and grounding system of this embodiment may also be adapted to other LED tube lamp forms, including those having a generally circular cross section and a single LED emitter board mounting surface as depicted in FIGS. 10 to 13.

The connector system 300 of the embodiment of FIG. 13 includes first connector part 310 formed as part of first end cap assembly 314 and second connector part 320 secured to support 50. The first end cap assembly 314 consists of a first, cup-shaped receptacle into which the first end of the LED tube lamp body extends. The first end cap assembly 314 is shaped to accommodate the multi-sided heat sink 354. It comprises side walls 312 extending perpendicular from end wall 330 and forming a receptacle having a generally triangular cross-section. Similar to the embodiments of FIGS. 10-12, first end cap assembly 314 includes an internal ground plate 332, which is shown in the cutaway view of FIG. 13. The second connector part 320 is of similar design as the connector part 220 described above in connection with the embodiment of FIG. 10. It is adapted to extend through an opening in the upper facing side wall of first end cap assembly 314 and form a snap-fit connection to the first connector part by the action of bendable members 322 and live hinges 325 on opposite sides thereof in essentially the same manner described for other embodiments. Second connector part 320 further includes ground strap 338*a* on one side thereof for engaging ground plate 332 of first connector part 310 when the two connector parts are in the engaged configuration. The ground plate 332 is in electrical contact with heat sink 354 through metallic fasteners 334, which extend through the aligned apertures of end wall 330, ground plate 332 and end connector board 360 and into corresponding mounting apertures 357 in the end face of the heat sink. Ground strap 338*a* is secured to ground wire 76. Thus, in essentially the same manner described above in reference to the embodiment of FIG. 10, the ground plate 332, fasteners 334, ground strap 338*a* and ground wire 76 provide a means to ground protect heat sink 354 when LED tube lamp 350 is installed in the operating state to the support using end connector 300.

The end connector board 360 of this embodiment is a PCB connector board having L-shaped electrical connector components 362, 364 thereon that insert into corresponding spaced receptacles in second connector part 320 and cooperate with connector assemblies 72, 74 having wires that extend through the second connector part 320 to establish electrical connection between the board 360 and the power supply. The connector components 362, 364 may be mechanically and electrically connected to the board 360, and the board includes traces to provide electrical paths from the connector components to terminals such as terminals 365. The terminals 365 cooperate with pins 372 extending from LED emitter boards, driver circuit boards or other electrical component to provide power to such components. Thus an electrical path is established between the power supply and the internal componentry of the LED tube lamp 350 when the first and second connector parts of connector 300 are in the engaged configuration.

In the embodiment shown, end connector board 360 also includes L-shaped electrical ground pin 366. Second connector part 320 has a female receptacle 342 adapted to receive the vertically extending portion of the ground pin 366 when the first and second connector parts 310, 320 are in the assembled configuration. Receptacle 342 includes an internal connector component (not shown) that forms an electrical path with ground wire 76, or with a separate ground wire, such that ground pin 366 may function to provide additional ground protection for LED tube lamp 350. In a preferred aspect, end connector board 360 includes traces electrically connecting ground pin 366 to one of the terminals 365 to provide an isolated grounding path for the internal components of the lamp 350 connected to the terminals 365. In another aspect, ground pin 366 may also be electrically connected to wire 367 and its loop connector 368. One of the fasteners 334 may extend through the loop connector 368 to form a ground connection between heat sink 354 and ground pin 366. This may provide for redundant grounding of the heat sink, or may render the ground strap 338*a* and ground plate 332 unnecessary. Alternatively, ground pin 366 may be electrically connected to the edge of one or more of the screw apertures via internal traces of end connector board 360 and the wire 367 eliminated. The embodiment of FIG. 13 thus provides multiple options for providing ground fault protection to internal componentry and the heat sink. In a preferred form, ground strap 338*a* and ground plate 332 provide a grounding path for heat sink 354, and ground pin 366 functions to ground the internal componentry of the LED tube lamp.

The ground protected LED lamp connector embodiments described previously provide a ground path for the lamp heat sink and/or internal components at an end of the lamp adapted to receive power from an external power supply. It will be recognized that any of the above embodiments may modified to provide a ground protected snap-fit connector system for the no power end of a single end powered lamp. For example, end connector board 260 of the embodiments of FIGS. 10-12, and associated connectors and wires, may be eliminated at the no power end with the connector 200 still functioning to provide a ground path for the lamp heat sink in the same manner described above. Connector components 72, 74 are also unnecessary at the no power lamp end. Similarly, end connector board 360 may be eliminated to adapt connector 300 of FIG. 13 for a lamp end that does not receive external power. Alternatively, end connector board 360 may be provided without L-shaped connector components 362, 364, but with ground pin 366 to provide isolated ground protection to the lamp internal components in the manner described. The system is thus highly adaptable to a variety of LED lamp designs and powering options, as may be flexibly implemented to suit the needs of each individual lighting installation.

Figure 14:
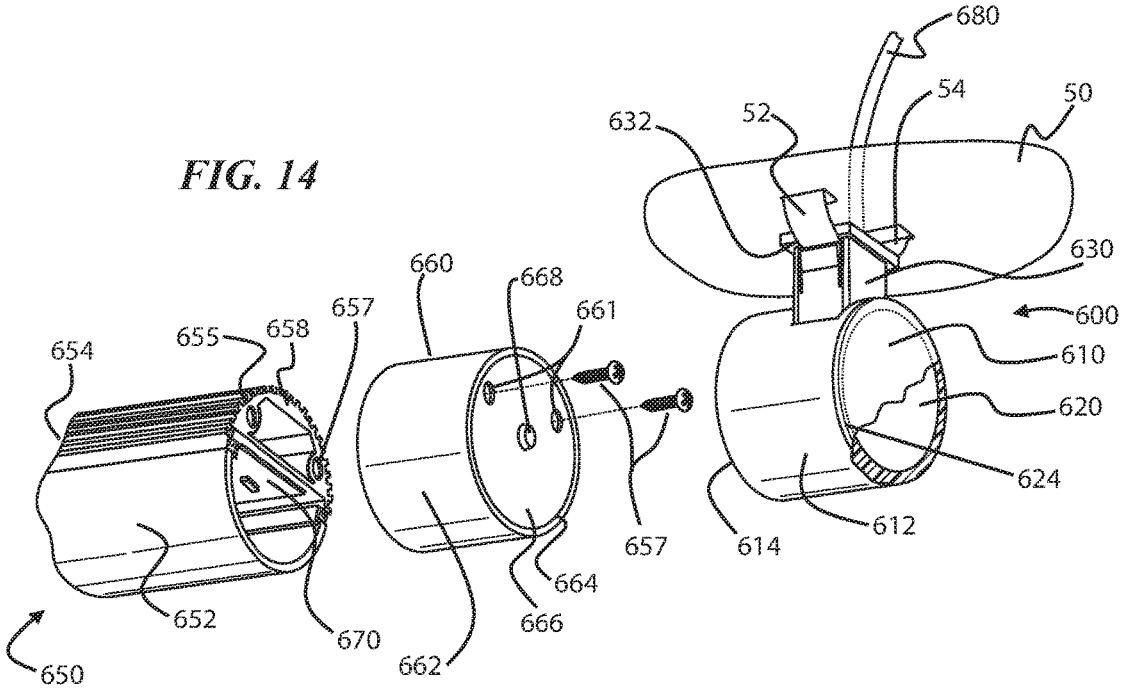
FIG. 14 is a fragmentary, perspective view of an elongate tubular lighting assembly, and showing cooperating connector parts comprising a connector sleeve at a no power end of a body and including cooperating ground protection components.

FIG. 14 is directed to an alternative connector system adapted to secure the no power end of a linear LED tube lamp to a light fixture, as well as to provide ground protection to the lamp heat sink. Connector sleeve 600, which is preferably an injection molded plastic component, is of a form similar to connector sleeve 520 discussed above with reference to FIG. 9. A base portion 630 of connector sleeve 600 includes slots 632 on opposite sides thereof into which tabs 52, 54 of support 50 slide to secure connector sleeve 600 to support 50. The base portion 630 extends toward sleeve portion 624 comprising cylindrical sidewall 612 and end wall 610, which form a cylindrical receptacle 614 sized to receive cylindrical end cap assembly 660 of the no power end of LED lamp 650. Connector sleeve 600 includes ground plate 620 comprising a conductive material and mounted adjacent the inner surface of end wall 610. Ground plate 620 is electrically connected to ground wire 680. The sleeve portion 624 is preferably of a cross-sectional shape selected to match the cross-sectional shape of plastic end cap assembly 660, which is cylindrical in the illustrated embodiment. Connector sleeves comprising a sleeve portion of other cross-sectional geometries, such as generally triangular, square or rectangular, are also contemplated for use with other lamp designs.

LED tube lamp 650 comprises heat sink 654 of a semi-circular cross-section and having a support surface on which LED emitter board 670 is mounted. Translucent lens cover 652 is attached to heat sink 654. End cap assembly 660 forms a cylindrical receptacle into which and end portion of the heat sink and lens cover inserts. End cap assembly 660 is non-conductive and includes an annular lip 664 circumscribing a recessed mid-portion of the outer surface of the end wall thereof. Ground plate 666 is disposed in the recessed mid-portion and retained by lip 664. Ground plate 666 is of a conductive material and includes central boss 668 protruding outwardly of its outer surface. End cap assembly 660 is secured to the lamp by means of metallic fasteners 657 extending through apertures 661 of the end wall and ground plate and into mounting apertures 655 and 657 of end face 658 of the heat sink. Ground plate 666 is thus in electrical contact with heat sink 654 through fasteners 657.

In the same manner described above with reference to FIG. 9, the no power end LED tube lamp 650 of FIG. 14 inserts linearly into receptacle opening 614 of connector sleeve 600. The opposite power input end of lamp 650 is preferably configured with the snap-fit end cap assembly of the type discussed herein to provide for mechanical and electrical connection to a male snap-fit connector mounted to support 50 upon moving the power end upward towards and into engagement with the male snap-fit connector part. With lamp 650 secured to support 50 in its installed configuration, boss 668 is forced into abutting engagement with the exposed conductive surface of ground plate 620. This engagement completes a grounding path between heat sink 654 and ground wire 680, which may be grounded to the light fixture or to an external isolated ground connection to provide ground protection to the heat sink.

Ground plate 666 may be provided in various shapes, sizes and configurations adapted to establish the desired grounding connection in a wide range of available LED lamp end cap assemblies. It may be provided, for example, as one or more thin conductive straps mounted to the external surface of the end wall of end cap assembly 660 or integrated into the end wall using in-laid molding techniques. Ground plate 620 may also take on other forms besides the circular plate illustrated in the embodiment of FIG. 14. For example, ground plate 620 may be provided as a thin conductive clip mounted to the internal surface of end wall 610 and extending generally parallel and opposite ground plate of the end cap assembly 660. Instead of boss 668 provided on ground plate 666, a boss may be provided on the ground plate 620 protruding into the receptacle of connector sleeve 600 to provide for contact with a planar form of ground plate 666. It will be appreciated from the teachings herein, that various shapes, sizes and geometries of ground strap ground plate 666 and ground plate 620 are within the scope of the invention so long as these two components are adapted to come into physical contact with each other when the end cap assembly 660 is seated in connector sleeve 600 and the opposite lamp end secured to the support 50 by a snap-fit connector system of the type described herein.

Figure 15:
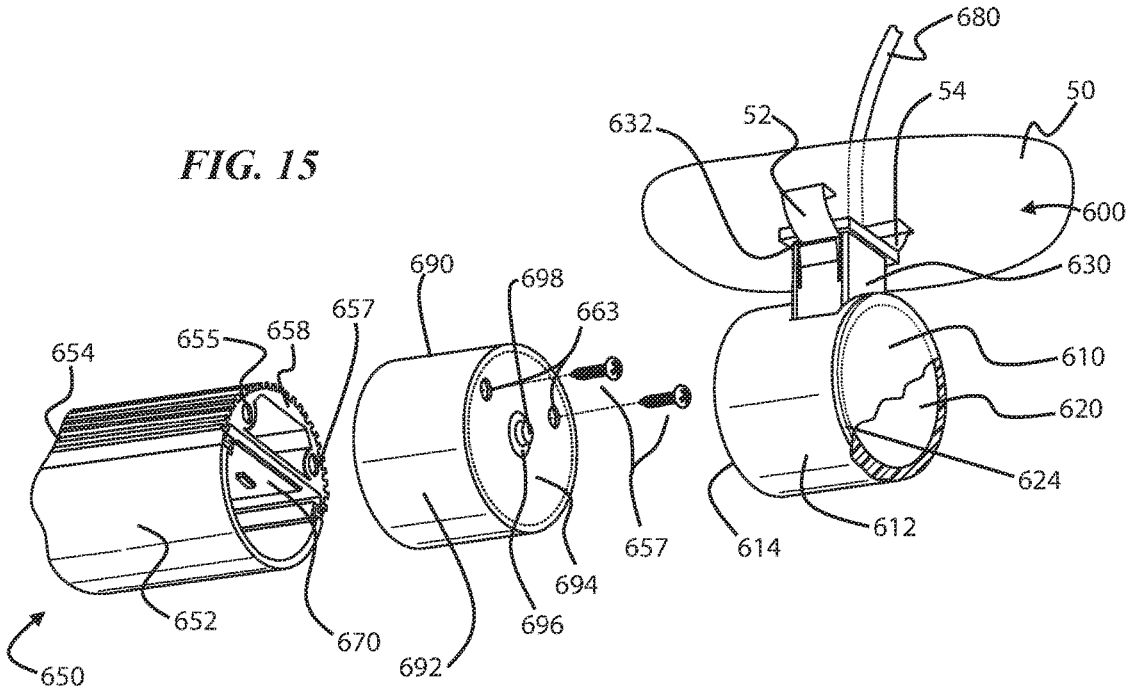
FIG. 15 is a fragmentary, perspective view of an elongate tubular lighting assembly, and showing cooperating connector parts comprising a connector sleeve at a no power end of a body and including alternative cooperating ground protection components.

As illustrated in FIG. 15, LED tube lamp 650 may be provided with an alternative end cap assembly 690 adapted for use with the same connector sleeve 600 just described. The end cap assembly in this embodiment comprises planar end wall 694 forming on outer end surface of the assembly and cylindrical side wall 692 which extends from the end wall. Ground plate 696 is mounted internal of end wall 694 as shown. Boss 698 of ground plate 696 protrudes through a central opening of end wall 694 as shown. Fasteners 667 extend through apertures 663 in the end wall and ground plate and into apertures 655 and 657 of end face 658 of the heat sink to secure end cap assembly 690 to the lamp. With end cap assembly 690 inserted into connector sleeve 600 to the assembled position, boss 698 abuts the exposed inner conductive surface of ground plate 620. This completes a ground path from heat sink 654 to ground wire 680 through the fasteners 657, ground plate 696 and ground plate 620.

The ground protected connector sleeve embodiments of FIGS. 14 and 15 provide additional options for safely grounding linear LED tube lamps. With the connector sleeve providing ground protection for the heat sink, the configuration of the connector system at opposite power input end may be simplified. In a preferred aspect, the connector sleeve provides a ground path for the heat sink and the snap-fit connector at the opposite power end is adapted to provide isolated grounding of the LED emitter boards and other internal electronic components such as by using a dedicated ground pin as disclosed in FIG. 13. This results in a fully grounded lamp having a simplified overall design.

Figure 16:
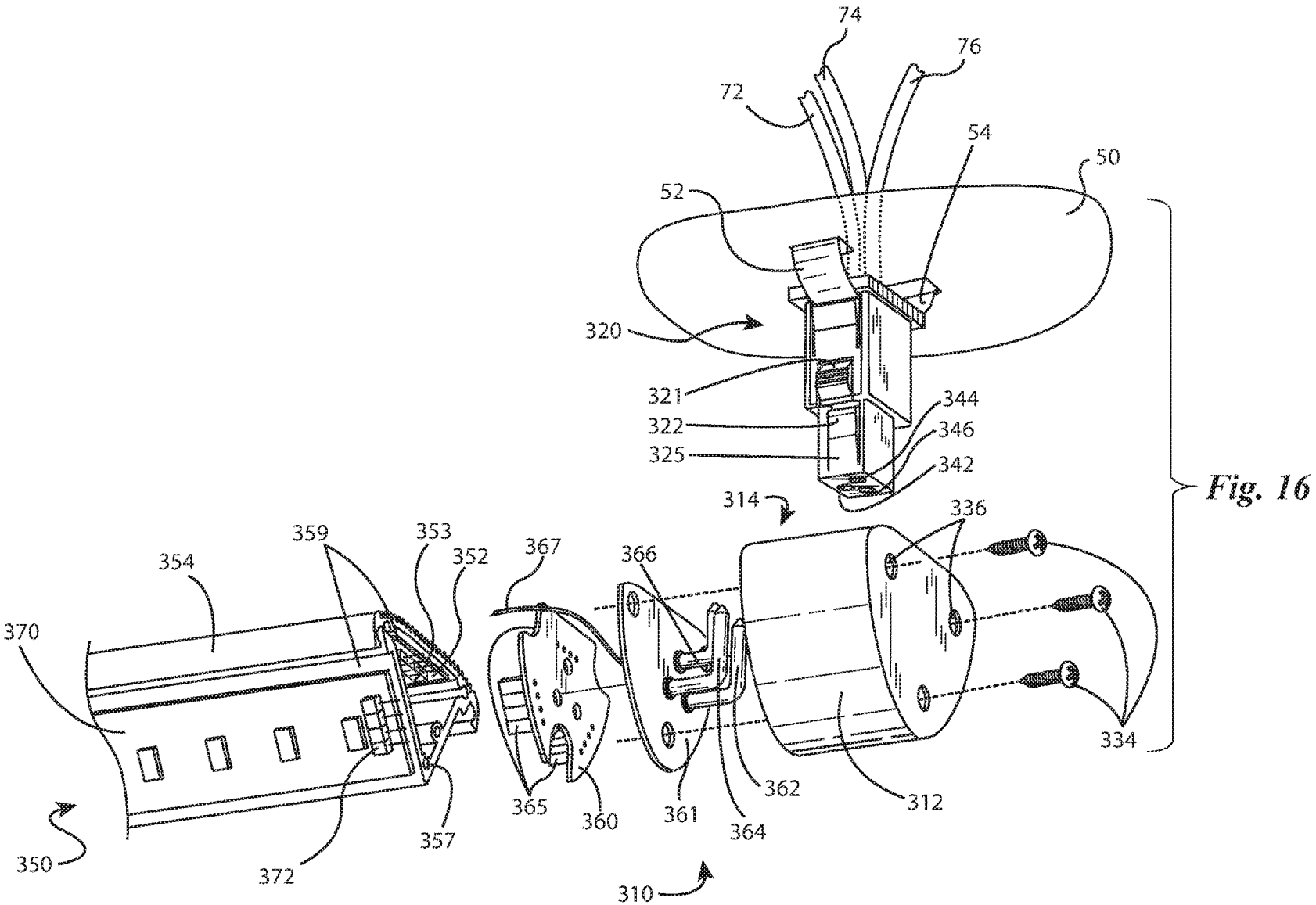
FIG. 16 is a fragmentary, perspective view of another embodiment of a multi-sided elongate tubular lighting assembly, and showing cooperating connector parts at one end of a body and including alternative cooperating ground protection components.

FIG. 16 illustrates another embodiment of the grounding system of the invention for ground protecting both the LED tube lamp heat sink and its internal LED emitter board and other internal electronic components. This embodiment illustrates an implementation of the invention in which ground protection is provided through use of a third L-shaped pin associated with the lamp end cap assembly. The body of multi-sided LED tube lamp 350 of this embodiment is substantially similar to the lamp shown in FIG. 13, and the description of like components is not repeated. The lamp 350 of FIG. 16 includes an internal driver board 352 with corresponding pin connector 353 mateable with one of the terminals 365 of end connector board 360. L-shaped pins 362, 364 and 366 are mounted to support board 361 and include stem portions that seat within corresponding mounting apertures of PCB end connector board 360. Alternatively, the support board 361 may be eliminated and the pins mounded directly to PCB end connector board 360.

The connector system 300 of the embodiment of FIG. 16 includes first connector part 310 formed as part of first end cap assembly 314 and second connector part 320 secured to support 50. The first connector part 310 and second connector part 320 function to form a snap-fit mechanical connection in the same way described previously in relation to the FIG. 13 and other embodiments. The first end cap assembly 314 is essentially the same as that of the embodiment of FIG. 13 except that ground plate 332 has been eliminated. In this embodiment, the ground strap **228*a* has also been eliminated from the second connector part 320**.

The L-shaped electrical connector components 362, 364 of this embodiment are in the form of pins having engagement portions that insert into corresponding spaced receptacles 346, 344 extending within second connector part 320. The pins cooperate with connector assemblies 72, 74 having wires and corresponding connector terminals that extend through the second connector part 320 to establish electrical connection with the pins and thereby form an electrical path between the lamp internal components and the power supply. The connector components or pins 362, 364 are mechanically and electrically connected to the end connector board 360, and the board includes traces to provide electrical paths from the connector components to terminals such as terminals 365. The terminals 365 cooperate with pins 372 extending from LED emitter boards and pins 353 extending from the driver circuit board 352 to provide power to those components. Thus an electrical path is established between the power supply and the internal componentry of the LED tube lamp 350 when the first and second connector parts of connector 300 are in the engaged configuration.

In the embodiment shown, the heat sink and/or lamp electronic components are ground protected through the third L-shaped connector component 366, which functions as a dedicated grounding pin. The second connector part 320 has a female receptacle 342 adapted to receive the vertically extending engagement portion of the ground pin 366 when the first and second connector parts 310, 320 are in the assembled configuration. Receptacle 342 includes an internal connector component (not shown) that forms an electrical path with ground wire 76 to enable the ground pin 366 to provide ground protection for linear LED lamp 350. In a preferred aspect, end connector board 360 includes traces electrically connecting ground pin 366 to one of the terminals 365 to provide an isolated grounding path for the internal components of the lamp 350 connected to the terminals 365. In another aspect, ground pin 366 may also be electrically connected to wire 367. The wire may be utilized to form a mechanical ground connection to the heat sink or to a pad on driver circuit board 360. In another aspect, the heat sink may be grounded by means of internal electrical traces in end connector board 360 which connect ground pin 366 to conductive edge portions of one or more screw receiving recesses that engage a corresponding assembly screws 334 when the end cap is assembled to the heat sink.

LED lighting products as well as the systems in which they are used are subject to safety and electrical isolation requirements, which are defined in safety standards. Various standards organizations around the world determine individual standards and issue approvals or certificates for equipment and products. Some important standards bodies include Underwriters Laboratories (UL), the American National Standards Institute (ANSI), the International Electrotechnical Commission (IEC), the Canadian Standards Association (CSA) and the Deutsche Elektotechnische Kommission (DKE). The equipment level specifications reference general standards on insulation, such as: IEC60664—Insulation coordination for equipment within low-voltage systems, and UL840—Insulation coordination including clearances and creepage distance for electrical equipment. Besides equipment level specifications there are component level standards.

The distance between components that is required to withstand a given voltage is specified in terms of "clearance" and "creepage." Creepage distance is defined as the shortest path between two conductive materials measured along the surface of an isolator which is in between. Creepage is an important characteristic because reduced creepage will result in the flow of current or "tracking" along the surface of the insulation. Tracking causes localized heating and carbonization of the surface, and may lead to failure of the insulation. The Comparative Tracking Index (CTI) is used to measure the electrical breakdown (tracking) properties of an insulating material. Creepage also depends on contamination of the surface, humidity, corrosive chemicals and the altitude in which the equipment is installed. Clearance distance describes the shortest distance between two conductive materials measured through air. Sufficient clearance distance prevents an ionization of the air gap and a subsequent flashover. Similar to creepage distance, the pollution degree, temperature and relative humidity influence the tendency for a breakdown.

FIG. 16 illustrates a preferred arrangement of the electrical connector components 362, 364 and the ground electrical connector component 366 to satisfy the spacing distance between electrical conductors required for a wide range of voltage levels, as well as to assure that the system is grounded before external power is applied. Ground pin 366 is shown mounted at a laterally centered position, and the power electrical connector components 362, 364 are mounted on opposite sides of the board's lateral midline and spaced approximately equally therefrom. Ground pin 366 attaches to support board 361, and to end connector board 360, at a position vertically offset from the connector components 362, 364, and the tip of its vertically extending engagement portion protrudes above the tip of the vertically extending engagement portions of connector components 362, 364 in the vertical direction. The internal connector components preferably extend approximately the same distance within second connector part 320 so that their ends are generally aligned at a position adjacent the leading end face thereof, and preferably at a position recessed from the leading end face. As first end cap assembly 314 is moved upward into an engaged configuration and the pins insert into the corresponding receptacles of second connector part 320, ground pin 366 will engage its corresponding internal connector component to form an electrical ground circuit for the linear LED lamp before the connector components 362, 364 engage their corresponding connector components of second connector part 320. This enhances overall safety by assuring the system is grounded before power is applied to the linear LED lamp. This is illustrated further in relation to the embodiment illustrated in FIGS. 17 to 21, and in particular FIGS. 19*a* and 19*b* and the corresponding discussion below.

The horizontal leg portions of L-shaped electrical connector components 362, 364 shown in FIG. 16 extend further in the longitudinal direction of the linear LED lamp 350 than the horizontal leg portion of ground electrical connector component 366. The illustrated positioning and configuration of the connector components 362, 364 and 366 provides increased creepage distance between these components, allowing the connector system to satisfy creepage requirements over a wide range of voltage operations. This is explained more fully in relation to the embodiment of FIGS. 17 to 21, which illustrates a similar connector system for a generally cylindrical linear LED lamp.

The linear LED lamp and connector system illustrated in FIGS. 17 to 21 is similar to the embodiments described FIGS. 10 to 12 but utilizes a third ground pin instead of an end cap ground plate and external strap system for providing ground protection to the lamp heat sink and internal components. LED tube lamp 750 comprises an elongate tubular body portion including a metallic heat sink 754 extending throughout a generally upward facing portion of the circumference of the tubular body, and a transparent or translucent lens portion 752 extending throughout a generally downward facing portion of the circumference of the tubular body. The heat sink is preferably formed of an aluminum alloy, although other thermally conductive materials may be used. At least one LED emitter panel 770 comprising a printed circuit board mounting a series of LEDs is mounted to the heat sink internal to the tubular body. The heat sink may include fins 755 extending along its length to increase the effective surface area for transfer of heat to the atmosphere. The LED lamp 750 may include an internal ballast or driver module (not shown) or may alternatively utilize an external ballast associated with the lighting fixture. Heat sink 754 has a generally semi-circular cross-section in a plane perpendicular to the length of the lamp, with support wall 759 extending across the internal region thereof to provide a mounting surface for LED emitter panel 770. Other heat sink geometries are also contemplated, including, for example, a configuration such as the one illustrated in FIG. 16 comprising multiple support walls arranged in a generally V-shape and lying in intersecting planes for supporting multiple LED emitter panels arranged to distribute light over a wide area.

Figure 17:
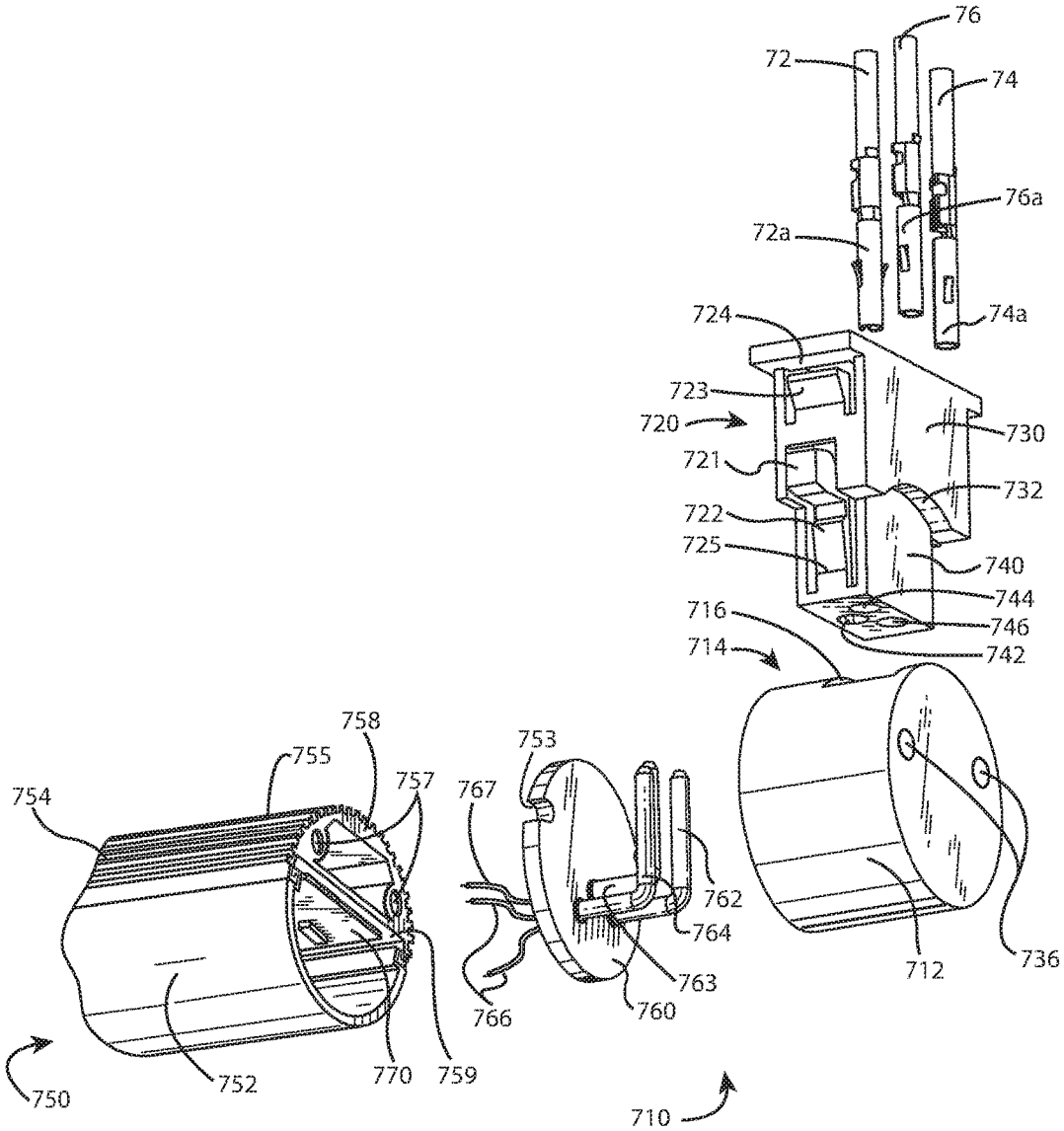
FIG. 17 is a fragmentary, perspective view of another embodiment of a generally cylindrical elongate tubular lighting assembly, and showing cooperating connector parts at one end of a body and including alternative cooperating ground protection components.

With further reference to FIG. 17, LED lamp 750 is mounted at its first end to a support of a lighting fixture (not shown) by means of snap-fit connector system comprising first connector part 710 and second connector part 720 configured to mount to the support. The second connector part 720 can be press connected to tabs of the support by means of oppositely opening slots formed between flanges 724 and flanges 723 extending outwardly from opposite sidewalls of second connector part 720. Of course other releasable, and potentially permanent, connections are contemplated.

Figure 19A:
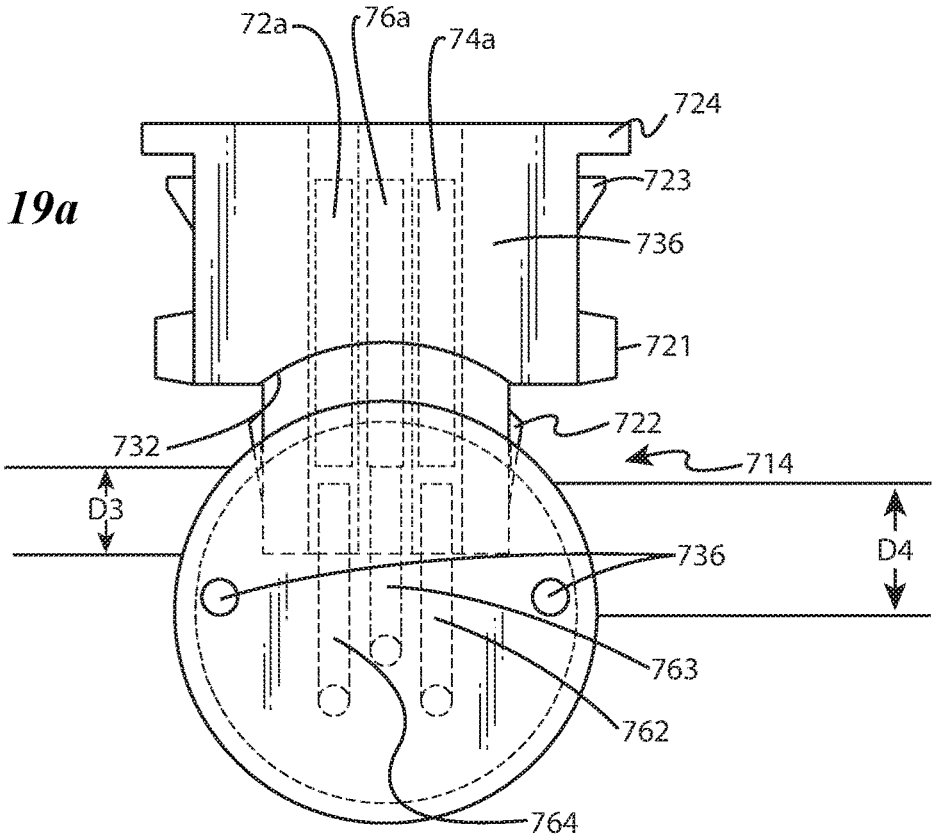
FIG. 19*a* is an end view of the cooperating connector parts in FIG. 17 in a partially assembled configuration.
Figure 19B:
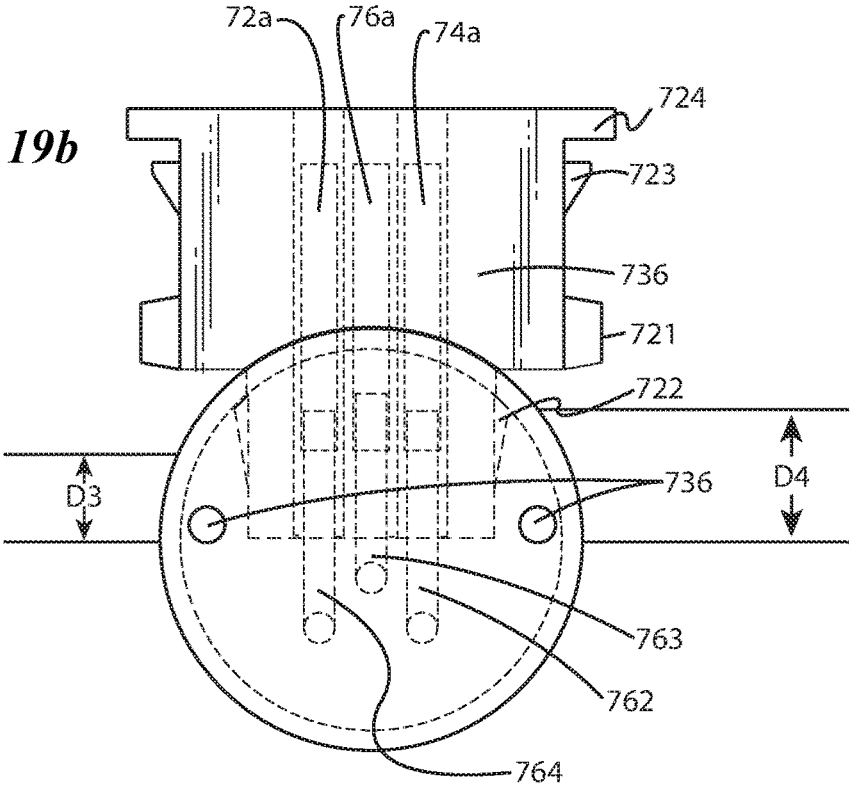
FIG. 19*b* is an end view of the cooperating connector parts in FIG. 17 in a fully assembled configuration.

As is further illustrated in FIGS. 19*a* and 19*b*, the second connector part 720 has a pair of bendable parts 722 on opposite sides thereof, each operable through hinge 725, which are engaged by the edge of the opening 716 and progressively cammed from a holding position towards an assembly position as the first connector part 710 is moved up to and into the engaged position. The first bendable parts 722 move from the assembly position back towards the holding position with the first part realizing the engaged position. The wall 714 resides captively between surfaces of the first connector part 710 in the engaged position to maintain this snap-fit connection. A pair of actuators 721 on opposite sides of second connector part 720 can be pressed to move the first bendable parts 722 towards its assembly position to allow them to pass through the opening 716 so that first connector part 710 can be separated from the second connector part 720. Second connector part 720 includes a curved concave ledge portion 732 at the juncture of sidewall 730 and sidewall 740 and has a generally planar opposite outer sidewall. This permits the second connector part 720 to insert further into the interior of first connector part 710, with a portion of the convexly curved outer wall portion of first connector part 710 seating within the curved ledge portion 732.

Heat sink 754 has a planar end face 758 at a first end thereof defining a pair of apertures 757. Connector end board 760 includes a pair of corresponding notches 753 aligned with heat sink apertures 757. The end wall of first end cap assembly 714 defines corresponding aligned apertures 736. The end cap assembly 714 and connector board 760 may be secured to heat sink 754 at the first end of LED tube lamp 750 with a pair of metallic fasteners (not shown) extending through the corresponding apertures and into the end face 758 of the heat sink. When assembled, the end board 760 and end portions of the heat sink and translucent lens portion 752 reside within the receptacle of end cap assembly 714.

As FIG. 17 illustrates, the receptacle of end cap assembly 714 may receive end connector board 760 having L-shaped electrical connector components 762, 764 and 763 thereon that cooperate with connector assemblies 72, 74 and 76 of second connector part 720. The connector assemblies have wires terminated with conductive cylindrical terminals 72*a*, 74*a* and 76*a* respectively that extend into the receptacles of second connector part 720. The wires of assemblies 72 and 74 connect to a power supply and the third wire 76 provides an isolated ground circuit. The connector components 762 and 764 may connect to LED emitter board 770 by means of wires 766 and may similarly provide power to other internal components of linear LED lamp 750. In one aspect, wires 766 connect to an internally mounted driver to provide AC line voltage which the driver converts to DC voltage supplied to the LED emitter board and optionally other internal componentry. The ground connector 763 may connect via wire 767 to the heat sink or to an internal driver board.

Figure 18:
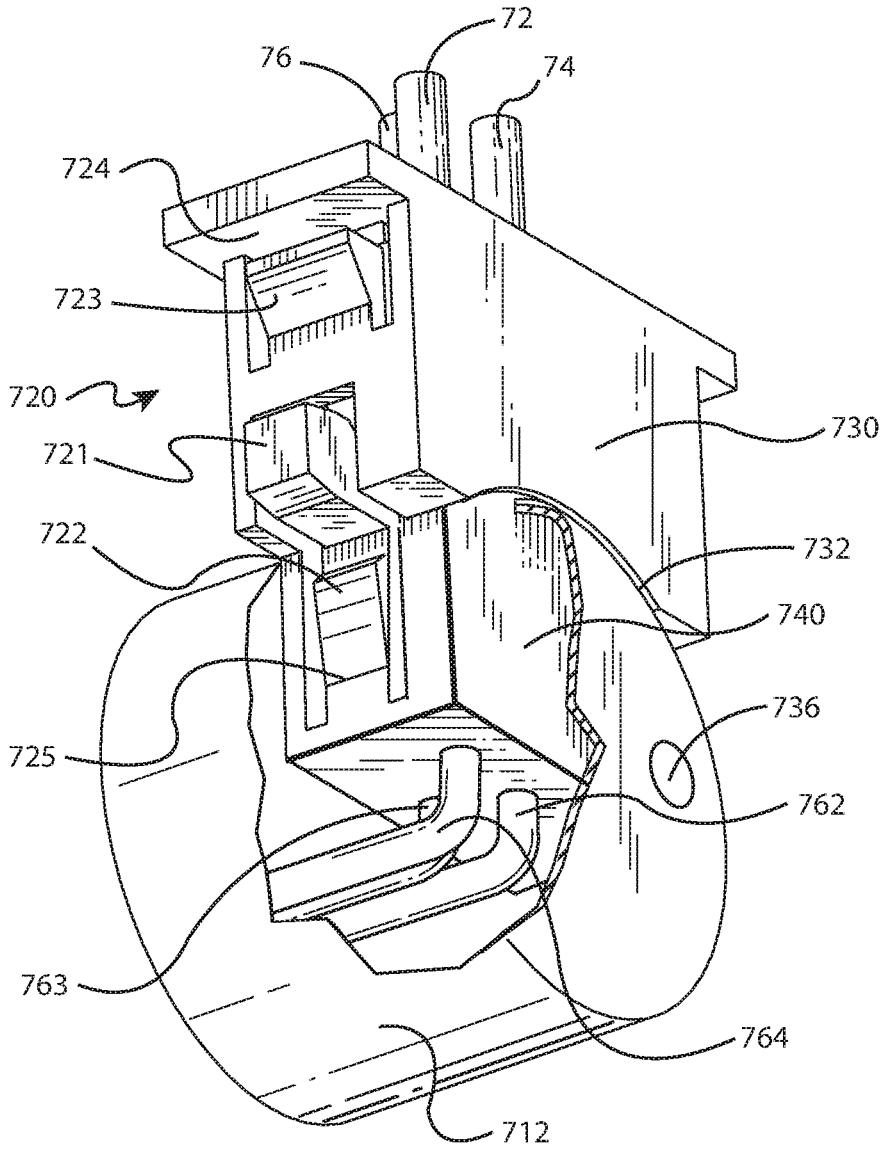
FIG. 18 is a perspective view of the cooperating connector parts in FIG. 17 in an assembled configuration.

The L-shaped electrical connector components 762, 764 and 763 on the connector board 760 each have a first portion extending horizontally in direction generally parallel to the length of the body and a second engagement portion extending vertically in a direction traverse to the length of the body and towards the second connector part 720 when said first connector part 710 is moved towards the second connector part and into the engaged position. The vertically extending engagement portions insert into corresponding spaced receptacles 744, 746 and 742 respectively in the leading end of second connector part 720 and engage the connector terminals 74*a*, 72*a* and 76*a* respectively that extend within the second connector part 720 to establish electrical connections with the power supply and a grounding circuit. FIG. 18 provides a perspective view showing the interaction of the components in the fully engaged configuration.

Although the embodiment illustrated in FIG. 17 utilizes internal wire connections, the connector board 760 may alternatively be in the form of a printed circuit board (PCB) connector containing male or female electrical terminals for connecting to corresponding terminals associated with LED emitter board 770, a driver circuit or other internal components of the lamp to provide a no-wire design. In both approaches, connector components 762, 764 provide an electrical path over which electrical power from a power supply is provided to the LED emitter board 770 and optionally other internal components, and the connector component 763 provides a grounding circuit.

The configuration of the L-shaped connectors shown in FIG. 17 is similar to that of the configuration shown in embodiment of FIG. 16. The advantages of this configuration in relation to satisfying spacing distance requirements between electrical conductors and other standards requirements is further explained by reference to FIGS. 19*a*, 19*b*, 20*a*, 20*b*, 21*a* and 21*b*.

FIG. 19*a* shows that ground connector component or pin 763 is mounted at a laterally centered position, and the power electrical connector components 762, 764 are mounted on opposite sides of the vertical diameter of support board 760 and spaced approximately equally therefrom. Ground pin 763 attaches to support board 760 at a position vertically offset from the connector components 762, 764, and the tip of its vertically extending leg protrudes above the tip of the vertically extending legs of connector components 762, 764 in the vertical direction. The internal connector terminals 72*a*, 74*a* and 76*a* extend approximately the same distance within second connector part 720 to positions offset from the leading end face thereof by the dimension shown as D3. As first end cap assembly 714 is moved upward into an engaged configuration and the pins insert into the corresponding receptacles of second connector part 720, ground pin 763 will engage its corresponding internal connector component to form an electrical ground circuit for the linear LED lamp before the connector components 762, 764 engage their corresponding connector components of second connector part 720, as shown in FIG. 19*a*.

FIG. 19*b* shows the relative positioning of the components with the first connector part 710 and second connector part 720 in the engaged position. In this embodiment, second connector part 720 is configured so that its leading end extends internally approximately one-half of the vertical diameter of end cap assembly 714 in the view shown. The vertical portions of connector components 762, 764 and 763 are of sufficient length so that they insert into the cylindrical terminals 74*a*, 72*a* and 76*a* respectively in the engaged position. The connector components may have a predetermined length selected to meet a minimum desired distance over which the connector components engage the terminals. For example, the vertical portions of connector components 762 and 764 extend the distance D4 from the centerline of the end cap assembly, and the pin engagement distance when the components are assembled is represented by D4 minus D3. In a preferred embodiment, the pins are configured to provide a pin engagement distance of at least 4.0 mm, and more preferably at least 4.3 mm.

Figure 20A:
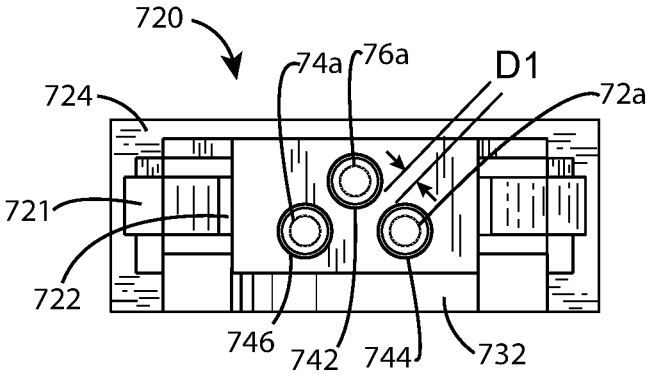
FIG. 20*a* is an end view of one of the connector parts in FIG. 17.
Figure 20B:
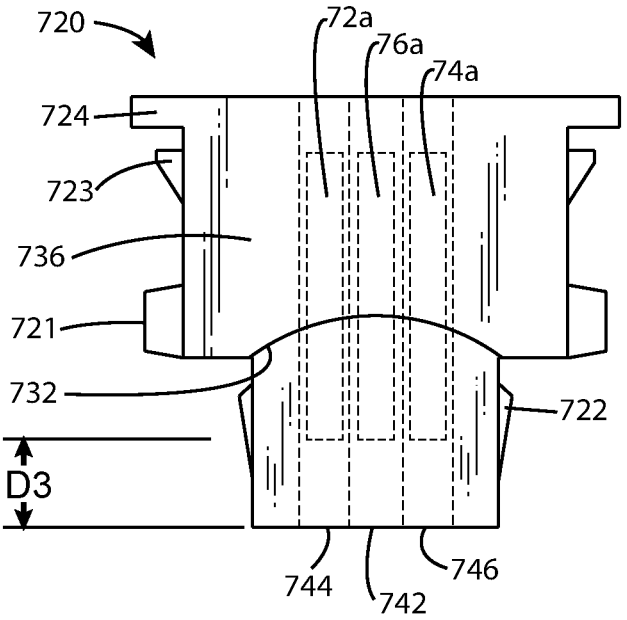
FIG. 20*b* is a side view of the connector part in FIG. 20*a;*

FIG. 20*a* is end view of the second connector part 720 showing the arrangement of receptacles 744, 746 and 742 accessible through openings in the end face of the leading end thereof. The connector terminals 74*a*, 72*a* and 76*a* housed within the receptacles are also shown. The shortest distance between adjacent conductors along the surface of the end face is the distance from the outer edge of receptacle openings 742 and 744, which is labeled as D1. This dimension is preferably at least about 2.0 mm to provide adequate electrical isolation at higher voltage operation. The outer edges of receptacle openings 746 and 744 for the power terminals are preferably spaced by at least 2.8 mm. As shown in the side view of FIG. 20*b*, the distance from the end of the terminals to the end face of second end connector 720 is D3. This dimension is preferably at least about 5.5 nm to provide adequate electrical isolation at higher voltage operation. Accordingly, the shortest path between two adjacent connector terminals measured along the surface of the isolator between them is the sum of D3 and D1 and D3. In a preferred form, second connector part 720 may be dimensioned such that this creepage distance is at least about 13.0 mm.

Figure 21A:
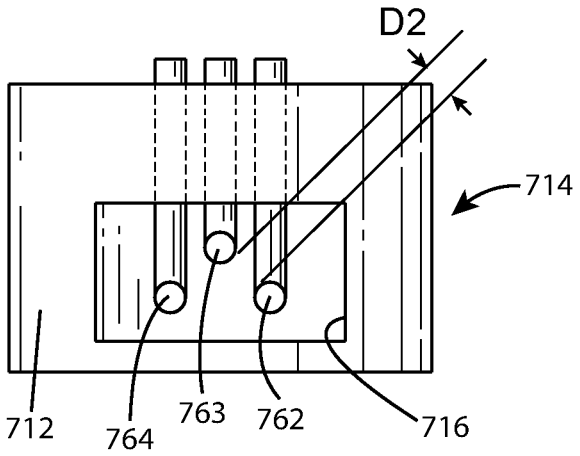
FIG. 21*a* is a side view of the other connector part in FIG. 17.
Figure 21B:
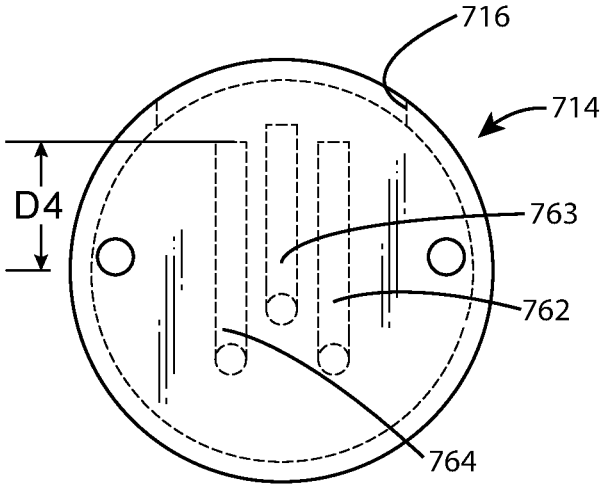
FIG. 21*b* is an end view of the connector part in FIG. 21*a*.

FIG. 21*a* shows a view of end cap assembly 714 from above, looking into opening 716. The clearance distance separated by air between any portion of adjacent connector components is preferably at least 3.0 mm, and more preferably at 3.2 mm to provide for safe operation at voltage levels up to 600 volts. The shortest distance separated by air between vertical legs of adjacent connector components is the distance between the vertical engagement portion of ground connector component 763 and the vertical engagement portion of either of the power connector components 762 and 764, which is designated D2 in FIG. 21*a*. This distance is preferably controlled to provide minimum clearance of at least 3.5 mm.

The ground protected connector systems disclosed herein provide safe and reliable means for securing linear LED tube lamps to a lighting fixture. The disclosed ground protected systems alleviate all safety concerns, permit high power operation, provide for flexible lamp design and installation options, and can be implemented in a cost-effective manner.

In a preferred aspect, the linear lamp 750 illustrated in FIGS. 17 to 21 connects to the support 50 of the lighting fixture by means of a similar second snap-fit connector system at its opposite end. The second snap-fit connector system need not include electrical connector terminals and may be provided without a means for connecting to the power supply. The opening 716 in first connector part 710 is preferably slightly larger than the corresponding dimensions of the leading end of connector 720, and the same relative sizing is preferable for the end cap assembly and support connector at the opposite lamp end. Sufficient clearance between the end cap openings and the leading end of the support connectors permits lamp 750 to be shifted slightly relative to the support connectors along the direction of its length or transverse to its length so that the vertical extending portions of connector components 764, 762 and 763 can be readily aligned with and inserted into receptacles 744, 746 and 742 during lamp installation.

Figure 22:
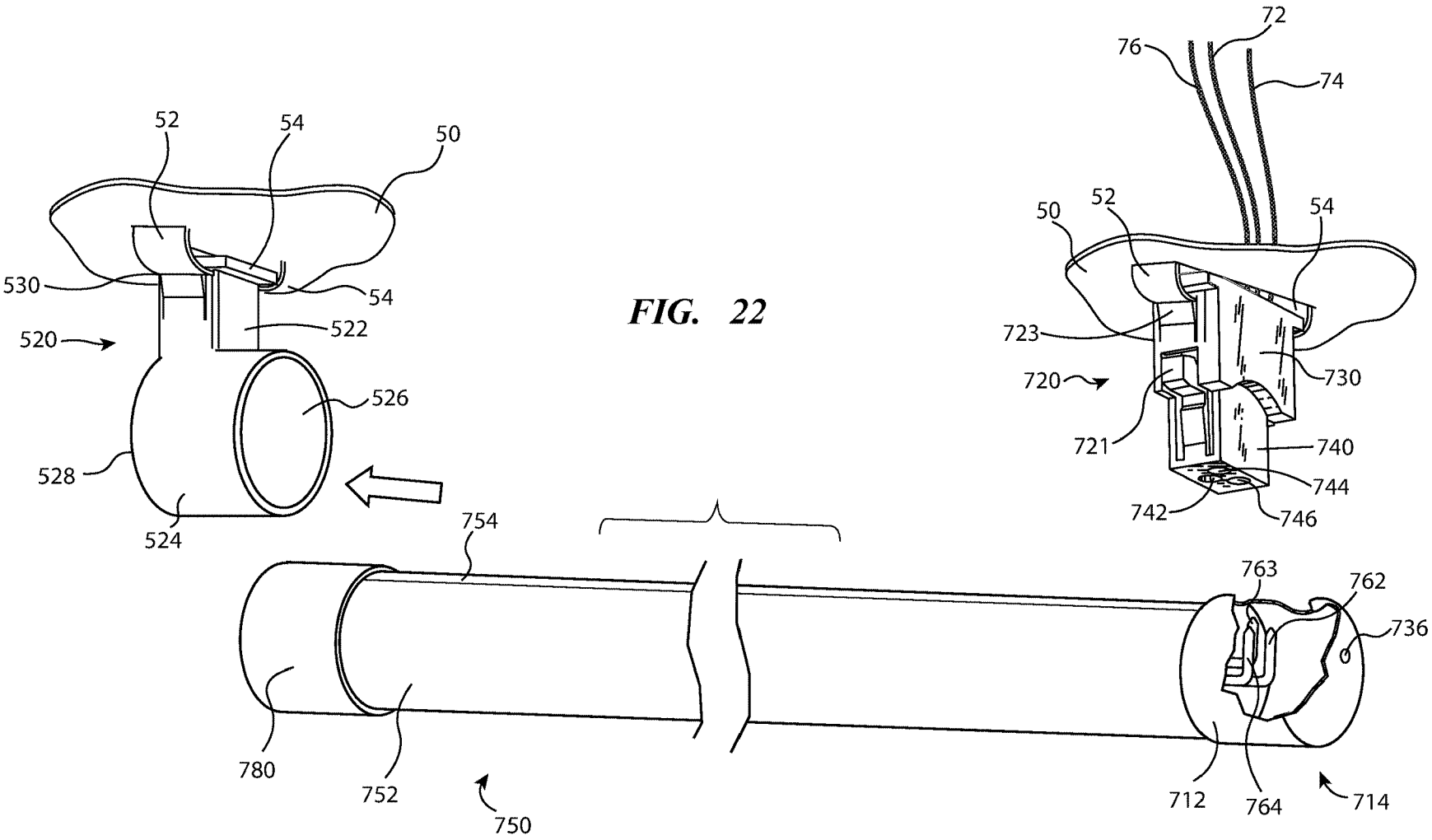
FIG. 22 is perspective view of a linear lighting assembly, and showing cooperating connector parts at each end of the body, with one set of cooperating connector parts configured to connect to an external power source with isolated ground protection.

FIG. 22 shows an alternative approach in which the opposite end of lamp 750 is connected to the fixture support by means of the cylindrical connector sleeve 520 shown previously in FIG. 9. The above description of connector sleeve 520 and its advantages is not repeated. The use of connector sleeve 520 may provide for easier installation, as discussed above. It also accommodates small variations in lamp length by permitting the lamp to be shifted linearly during installation so that connector components 764, 762 and 763 align with and inserted into receptacles 744, 746 and 742. Of course, connector sleeves comprising a sleeve portion of other cross-sectional geometries, such as generally triangular, square or rectangular, are also contemplated for use with other lamps having corresponding end cap cross-sectional geometries.

Those skilled in the art will recognize that a wide variety of modifications, alterations, and combinations can be made with respect to the above described embodiments without departing from the spirit and scope of the invention, and that such modifications, alterations, and combinations, are to be viewed as being within the scope of the invention.

What is claimed is:

1. A system comprising a linear LED lamp and first and second support connectors for maintaining the LED lamp in an operative state in the light fixture;

the linear LED lamp comprising:

a body with a length between spaced first and second ends;

a source of illumination comprising LED emitters on or within the body; an elongate heat sink in thermal communication with the LED emitters;

a first end cap assembly at the first end of the body comprising internal first and second conductive power pins and an internal conductive grounding pin, at least one of the conductive power pins adapted to provide power to the lamp and the conductive grounding pin electrically isolated from the conductive power pins and being connectable to a ground circuit, the pins each having an engagement portion extending in a direction traverse to the length of the body and towards an opening defined in a sidewall of the first end cap assembly without extending through the opening; and a second end cap assembly at the second end of the body, the second end cap assembly having a sidewall defining an opening configured to receive a leading end portion of a second support connector mounted on the light fixture;

the first support connector comprising:

a nonconductive housing comprising a first portion including a mounting base configured to couple the first support connector to a support of the light fixture and a second portion extending from the first portion and configured to be insertable within the opening of the first end cap assembly;

the second portion having sidewalls and a leading end wall extending traverse to the sidewalls, the leading end wall defining first, second and third openings;

first and second power electrical terminals and a grounding electrical terminal each disposed within the second portion in general alignment with a corresponding one of the openings;

the first and second power electrical terminals configured to mate with the engagement portion of a respective one of the first and second conductive power pins of the lamp when the power pins are inserted through the respective first and second openings and the grounding electrical terminal configured to mate with the engagement portion of the conductive grounding pin when the grounding pin is inserted through the third opening as the end cap assembly is moved relative to the first support connector from a position fully separated from the support connector in a path that is transverse to the length of the body into an engaged position;

the second portion having first and second parts on which respective second surfaces are defined, the second surfaces configured to engage corresponding first surfaces defined by the wall inner surface adjacent opposite ends of the opening of the first end cap assembly so that the first and second surfaces are placed in confronting relationship to prevent separation of the end cap assembly and the first support connector with the body in the operative state in the engaged position;

the second support connector comprising:

a mounting base configured to couple the second support connector to a support of the light fixture and a second portion extending from the first portion and configured to be insertable within the opening of the second end cap assembly, the second support connector configured to engage and mechanically connect to the second support connector as an incident of the second end cap assembly moving relative to the second support connector from a position fully separated from the second support connector in a path that is transverse to the length of the body into an engaged position.

2. A system comprising a linear LED lamp, a first support connector and second sleeve connector for maintaining the LED lamp in an operative state in the light fixture;

the linear LED lamp comprising:

a body with a length between spaced first and second ends;

a source of illumination comprising LED emitters on or within the body; an elongate heat sink in thermal communication with the LED emitters;

a first end cap assembly at the first end of the body comprising internal first and second conductive power pins and an internal conductive grounding pin, at least one of the conductive power pins adapted to provide power to the lamp and the conductive grounding pin electrically isolated from the conductive power pins and being connectable to a ground circuit, the pins each having an engagement portion extending in a direction traverse to the length of the body and towards an opening defined in a sidewall of the first end cap assembly without extending through the opening; and a second end cap assembly at the second end of the body;

the first support connector comprising:

a nonconductive housing comprising a first portion including a mounting base configured to couple the first support connector to a support of the light fixture and a second portion extending from the first portion and configured to be insertable within the opening of the first end cap assembly;

the second portion having sidewalls and a leading end wall extending traverse to the sidewalls, the leading end wall defining first, second and third openings;

first and second power electrical terminals and a grounding electrical terminal each disposed within the second portion in general alignment with a corresponding one of the openings;

the first and second power electrical terminals configured to mate with the engagement portion of a respective one of the first and second conductive power pins of the lamp when the power pins are inserted through the respective first and second openings and the grounding electrical terminal configured to mate with the engagement portion of the conductive grounding pin when the grounding pin is inserted through the third opening as the end cap assembly is moved relative to the first support connector from a position fully separated from the support connector in a path that is transverse to the length of the body into an engaged position;

the second portion having first and second parts on which respective second surfaces are defined, the second surfaces configured to engage corresponding first surfaces defined by the wall inner surface adjacent opposite ends of the opening of the first end cap assembly so that the first and second surfaces are placed in confronting relationship to prevent separation of the end cap assembly and the first support connector with the body in the operative state in the engaged position;

the sleeve connector comprising:

a housing comprising a mounting base configured to couple the sleeve connector to a support of the light fixture and a sleeve portion extending along a length of the light fixture, the sleeve portion having outer wall portions defining a receptacle configured to receive a portion of the second end cap assembly as the second end of the body is moved towards the connector in a direction substantially parallel to the length of the body into an engaged position with the sleeve connector whereby the sleeve connector secures the second end of the lamp body to the light fixture.

* * * * *